US005190471A

United States Patent [19]

Barile et al.

[11] Patent Number: 5,190,471

[45] Date of Patent: Mar. 2, 1993

[54] CABLE TERMINATION ASSEMBLY FOR HIGH SPEED SIGNAL TRANSMISSION

[75] Inventors: Dawn Barile, Euclid; John T. Venaleck, Madison; Randy G. Cloud, Painesville; Michael McCoy, Euclid, all of Ohio

[73] Assignee: Ohio Associated Enterprises, Inc., Painesville, Ohio

[21] Appl. No.: 654,794

[22] Filed: Feb. 13, 1991

[51] Int. Cl.[5] ..... H01R 9/07

[52] U.S. Cl. ..... 439/455; 439/484; 439/493; 439/497; 439/638; 439/862

[58] Field of Search ..... 439/67, 76, 77, 455, 439/492–499, 604, 606, 484, 638, 862

[56] References Cited

U.S. PATENT DOCUMENTS

| | | | |
|---|---|---|---|
| 3,082,292 | 3/1963 | Gore | 174/117 |
| 3,189,864 | 6/1965 | Angele et al. | 439/494 |
| 3,540,956 | 11/1970 | Arnold et al. | 156/54 |
| 3,634,782 | 1/1972 | Marshall | 174/117 F |
| 4,030,799 | 6/1977 | Venaleck | 439/499 |
| 4,066,840 | 1/1978 | Allgaier | 439/496 |
| 4,143,236 | 3/1979 | Ross et al. | 174/117 F |
| 4,326,764 | 4/1982 | Asick et al. | 439/497 |
| 4,722,692 | 2/1988 | Tengler et al. | 439/494 |
| 5,015,197 | 5/1991 | Redmond et al. | 439/493 |
| 5,035,641 | 7/1991 | Van-Santbrink | 439/67 |

FOREIGN PATENT DOCUMENTS

| | | | |
|---|---|---|---|
| 1172327 | 8/1984 | Canada | 439/606 |

*Primary Examiner*—Neil Abrams

*Attorney, Agent, or Firm*—Watts Hoffmann Fisher & Heinke

[57] ABSTRACT

A cable termination assembly including a multiconductor ribbon cable of the woven or Teflon insulation type includes loop connection portions for respective conductors with a stiffening insert located in respective loops, the loops being coupled to contacts via a printed circuit board interface for connecting the cable conductors to an external member, and a strain relief system including a rigid bar-like member directly molded or otherwise affixed to the cable and to which a housing portion of the cable termination assembly may grab in order to transmit force between the cable and housing without applying forces to the connections of the loops and the circuit board and/or contacts to which such loops are connected.

11 Claims, 15 Drawing Sheets

CABLE TERMINATION ASSEMBLY FOR HIGH SPEED SIGNAL TRANSMISSION

TECHNICAL FIELD

The present invention relates generally, as is indicated, to the terminating of multiconductor electrical cables, especially those used for transmission of high speed electrical signals. The invention, more particularly, relates to terminating woven electrical cables and other cables that have been difficult to terminate in the past, such as those having Teflon® or similar insulation, and to cable terminations and assemblies employing the techniques described in detail below. The invention also relates to a strain relief technique for cables used in cable termination assemblies.

BACKGROUND

In the electronics field it has become conventional to connect simultaneously plural electrical signals from one device, terminal, computer, etc., to another using multiconductor cable assemblies. Such a cable assembly typically includes a multiconductor cable and one or more cable terminations which provide electrical connections between the conductors and respective external members, such as pins, contacts, conductive paths on a printed circuit board, etc. A cable termination may be located at the end of the cable or at a location between the ends of a cable, and in the latter case sometimes the label daisy chain termination is used. The cable termination usually includes a plurality of electrical contacts, sometimes referred to as contacts, terminals, or the like, which are retained in a mechanical structure, such as a housing or some other relatively rigid body so that the contacts can be plugged into or otherwise mated with one or more appropriate external members to which electrical connection is intended. The housing usually is electrically non-conductive; or for shielding or like purpose it may be conductive, at least in part, without shorting to the signal contacts, conductors, etc.

A cable termination assembly is the combination of the cable termination and the cable itself, and typically there is provided in a cable termination assembly or in association therewith a strain relief mechanism (sometimes simply referred to as a strain relief). The object of the strain relief is to provide means for mechanically connecting the cable termination and the cable so that forces tending to separate the cable termination and the cable will tend not to be transmitted to the actual connections between cable conductors and contacts to which they are attached in the cable termination.

A cable termination located at an end of a cable typically is referred to as an end termination; one located between ends typically is referred to as a daisy chain type termination or with the cable, then, as a daisy chain assembly.

In U.S. Pat. No. 4,030,799 is disclosed a multiconductor cable termination assembly in which the plural electrical conductors (sometimes referred to as wires) of a multiconductor ribbon cable are mass terminated in a cable termination. The conductors are held in parallel with each other by insulation, the cable as a whole being in the form of what is commonly referred to as flat ribbon cable. The termination includes a plurality of electrical contacts that are mechanically and electrically connected to the cable and especially to the conductors thereof by insulation displacement connections (IDC), wherein a portion of each contact pierces through the cable insulation to engage a respective conductor. The termination also includes a strain relief body that is molded to at least part of each of the contacts and cable and which may be bonded chemically with the cable insulation for added integrity. While such cable termination assembly and cable thereof are useful for transmitting relatively low speed electrical signal, they are not as useful for transmitting relatively high speed signals due to cross talk and varying impedance conditions. Woven cable, Teflon insulation cable and like cables that provide shielding, grounding, controlled impedance, etc., are better suited for high speed signal transmission, such as high speed data transmission or the like, as is known.

A cable termination assembly that is especially suited for transmitting high speed signals is disclosed in U.S. Pat. No. 4,722,692. In such patent there is disclosed a multiconductor ribbon cable that uses a plurality of conductors to carry signals (hereinafter referred to as signal conductors for convenience) and a plurality of electrical conductors that are connected to a source of reference potential, such as ground (hereinafter referred to as ground conductors for convenience), to provide a measure of isolation between respective signal conductors and to help control impedance characteristics of the cable. Moreover, in at least one embodiment the cable insulation is made of a material, such as polytetrafluoroethylene (also sold under the trademark Teflon®), which has particularly advantageous electrical insulation, impedance, and other characteristics. A disadvantage to using Teflon is the problem encountered in connecting a cable termination or a strain relief thereto, as Teflon ordinarily does not bond to other materials.

In U.S. Pat. No. 4,722,692 the conductors of such cable are exposed by removing a portion of insulation at the end of the cable, severing and sliding another portion of the insulation along the conductors to take the place of the removed insulation portion on the conductors while exposing portions of all the conductors off which the latter insulation portion was slid, and bending (knuckling) the exposed conductor portions to form U-shape loops exposed out of the plane of the cable for connection to respective contacts. Additional slots are formed in the cable insulation, and a strain relief (e.g., of plastic material) is molded to the cable with portions of such strain relief being secured to the cable by portions of the welding material flowing through the slots to form legs in the slots. A disadvantage to such cable termination assembly and to the method of terminating such cables is the substantial amount of labor required to prepare the cable and to attach it to respective contacts of the termination. Another disadvantage is the lack of stiffness (weakness) of the conductors where they all are exposed. Other disadvantages are that all ground conductors exit the end of the cable requiring special terminating thereof and that all signal conductors are knuckled respectively above or below the plane of the cable, thus limiting the termination therefor to an in-line type that extends parallel to the cable plane.

U.S. Pat. No. 4,143,236 to Ross discloses a woven cable. The woven cable is formed of a plurality of electrical conductors (wires) each of which is independently insulated. The insulated conductors are woven in a manner similar to the way the threads of a fabric are woven, forming a multiconductor ribbon cable. The conductors are woven such that each undulates in a somewhat sinusoidal fashion with a frequency (or wavelength also known as pick length) between peaks along the axial length of the cable, e.g. along the center plane of the cable. The frequency may be selected to be longer or shorter as a function of the weaving process, and the peaks of respective conductors may be in phase, out of phase by some amount, e.g., 90°, 180°, or some other amount, or may vary in some other way, all as a function of the programmed weaving process. Threads are woven in the cable in warp (parallel with the conductors) and weft (transverse to the conductors) directions.

The conductors of such woven cable may be arranged and/or designated in a variety of relationships, e.g., the carrying of electrical signals and the providing of ground reference potential condition. In one example there may be only one ground conductor between each pair of otherwise adjacent signal carrying conductors. In another example there may be a separate dedicated pair of ground conductors for each signal conductor within the plane of the cable. This configuration then would include at the edge of the cable a ground conductor, followed by a signal conductor (as one moves inward from the edge of the cable in the plane of the cable), followed by two ground conductors, another signal conductor, two ground conductors, etc., as is known, for example, from U.S. Pat. Nos. 4,143,236 and 3,634,782 (Marshall). This type of configuration is particularly suitable for high speed signal transmission with good impedance control characteristics.

One disadvantage to the use of woven multiconductor cables is the difficulty in connecting the conductors thereof to the contacts of a cable termination. In the past each conductor was stripped of insulation at the end of the cable, and the bare conductor wire (also referred to as "cable conductor" herein without the designation "wire") was soldered to a contact or to solder pads on a printed circuit board to which contacts also were connected. That procedure was time-consuming, difficult, and expensive. Moreover, there was no convenient form of strain relief available for securing the cable to the termination in a manner that avoids applying stress or strain to the junctions of the contacts and conductors. As is known, it is difficult, if not impossible, to mold accurately to a woven material. The ability to shut off the mold so that there is no leakage, wicking, etc., is difficult if not impossible; therefore, the accuracy, completeness, etc. of a part molded to a woven material would be somewhat uncontrolled.

One type of electrical cable that is especially suited for high speed signal transmission is known as coaxial cable in which there typically is a signal carrying conductor and a surrounding conductive material that is maintained at a predetermined reference potential, such as ground. Usually the circumscribing conductive material is relatively fragile, such as a foil material, and a drain wire is positioned in engagement with such material to maintain the electrical continuity thereof in the event of a tear in such material. Another similar type of high speed signal transmission cable is referred to as a triax cable. Typical prior techniques for terminating such coaxial cables and triaxial cables required a separate cable termination for each cable, each such termination including a pair of contacts (one for the signal conductor and one for the ground), a housing for retaining the contacts, and a strain relief mechanism.

The disclosures of all of the patents mentioned herein are hereby incorporated in their entirety by reference.

BRIEF SUMMARY OF THE INVENTION

Features of the invention include techniques to facilitate terminating woven ribbon cable and Teflon or other relatively solid insulation ribbon cable, especially those used for high speed signal transmission. Other features include improvements in strain relief techniques and pull tab arrangements. Other features and advantages will become evident from the following description with reference to the drawings.

Briefly, according to one aspect of the invention a cable termination assembly includes a multiconductor ribbon cable; a plurality of the cable conductors having loop-like connection portions located along the length of the cable, being generally in co-planar spaced-apart relation, and wherein at least some of the connection portions protrude to one side of the cable; an insert between the major planar extent of the ribbon cable and at least some of the connection portions to rigidify the protruding extent of at least some of the connection portions and for holding the same in substantially coplanar relationship; electrical contacts, terminals, circuits or the like for conducting electrical signals with respect to such connection portions; and an electrically non-conductive housing or the like for holding the cable and contacts in positional relationship for such electrical conducting function.

According to another aspect an improvement for a cable termination system, which includes a cable intended to carry one or more signals, and a termination including contacts, circuits or the like for coupling such signals beyond such cable, is provided as a strain relief member directly molded to at least part of such cable to secure intimately therewith and to provide a surface onto which further means may grab to hold the strain relief member and thus such cable in positional relation to such termination, whereby application of force tending to separate such cable from such termination will be isolated from the area of coupling of such cable and contacts, circuits or the like.

Another aspect relates to a cable for carrying one or more signals including an exterior surface, a termination portion at which at least one of such signals may be coupled to another device, and a strain relief directly molded to at least a portion of the exterior surface to form a substantially integral structure with such cable, the strain relief being operable to be secured in a holder to hold the same and the cable relative to such holder and to conduct force applied between the holder and cable without stressing the termination portion.

Even another aspect relates to a method of making a cable termination assembly for a multiconductor cable including molding a rigid part onto such cable in relatively fixed position on such cable, attaching electrical contacts, terminals or the like conductive means to conductors of such cable, attaching a housing structure to such cable, contacts and rigid part whereby such housing structure securely holds to such rigid part to the extent that force tending to separate such housing structure from such cable will tend not to be transmitted to connections between such conductors and such contacts, terminals or conductive means.

Still another aspect relates to a technique for molding part of a strain relief for a cable termination assembly to a cable, for example, a woven cable, wherein accurate molding technique to overcome wicking and/or like inaccuracies during molding is unnecessary, yet the molded part may be secured to a further housing part of the cable termination assembly to complete a strain relief relationship.

Yet another aspect concerns improving versatility of a cable termination allowing it to have low profile to conserve space while permitting the convenient addition of a pull tab mechanism to pull the cable termination away from another connector or the like.

The foregoing and other objects, features, aspects and advantages of the present invention will become more apparent as the following description proceeds. It will be appreciated that while several embodiments of the invention are described herein, the scope of the invention is to be determined by the claims and equivalents thereof. Also, although several embodiments having different features are shown in the several drawing figures, it will be appreciated that various features shown in one drawing figure and/or with respect to a particular embodiment often may be employed in other embodiments.

To the accomplishment of the foregoing and related ends, the invention, then, comprises the features hereinafter fully described in the specification and particularly pointed out in the claims, the following description and the annexed drawings setting forth in detail certain illustrative embodiments of the invention, these being indicative, however, of but several of the various ways in which the principles of the invention may be suitably employed.

DETAILED DESCRIPTION

Figure 1:
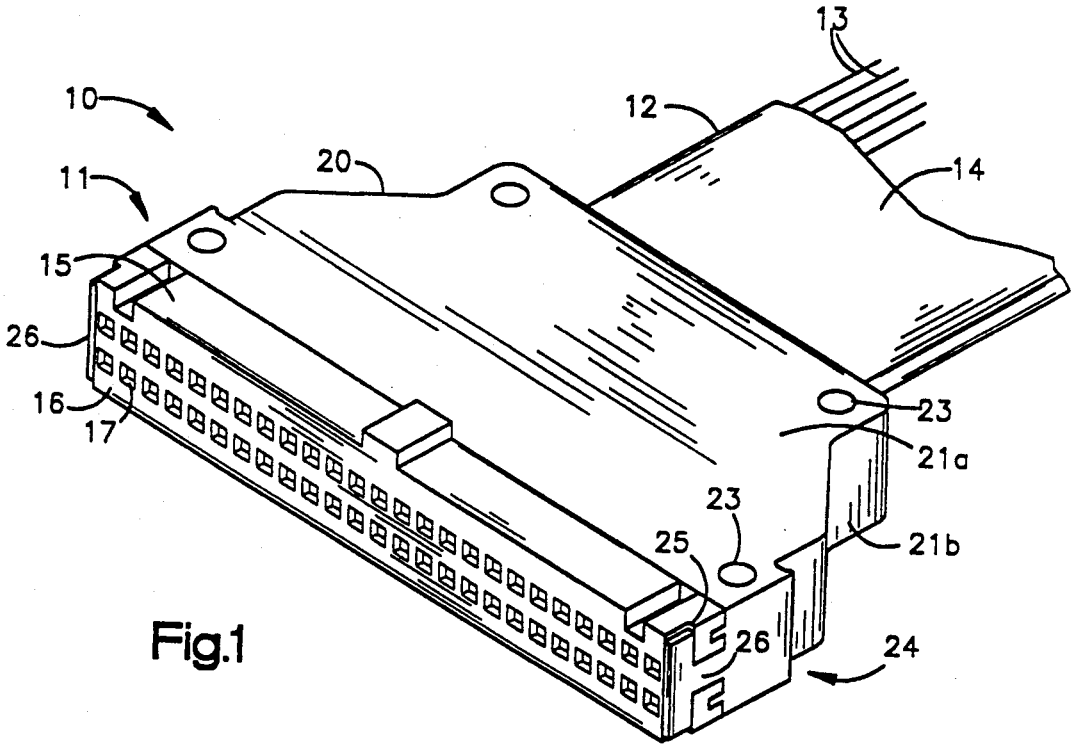
FIG. 1 is an isometric view of a cable termination assembly in accordance with the present invention.
Figure 2:
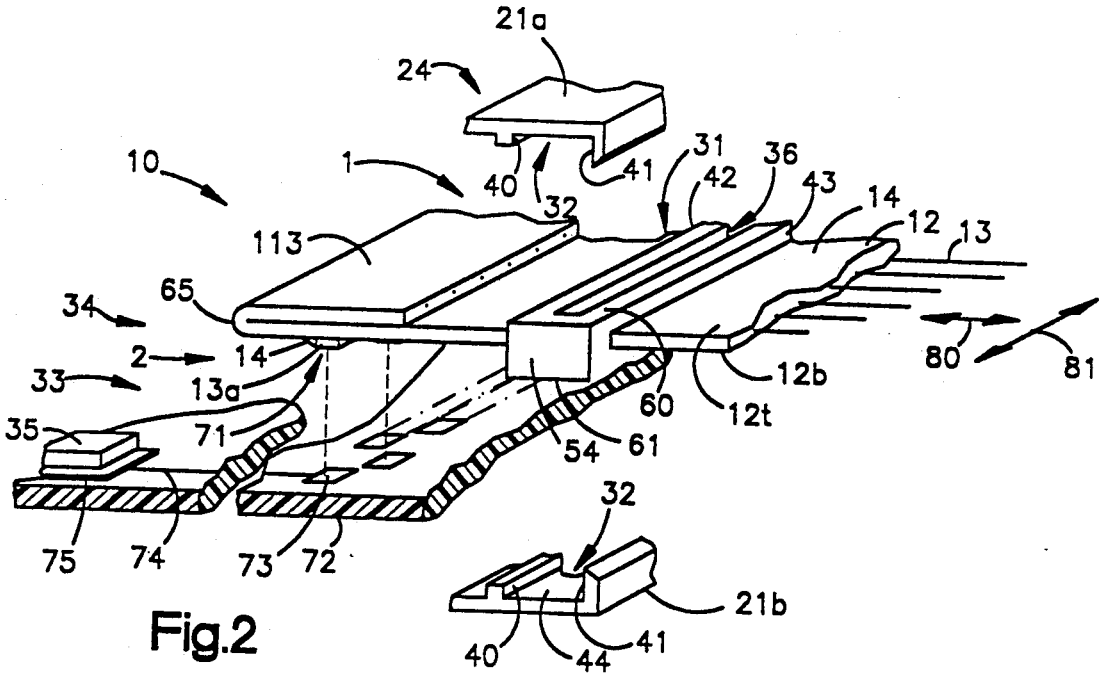
FIG. 2 is an exploded fragmentary isometric view of an interior portion of the cable termination assembly of FIG. 1, including part of the cable, strain relief bar, cover, printed circuit board, and contacts.

Referring, now, to the drawings, wherein like reference numerals designate like parts in the several figures, and initially to FIGS. 1 and 2, a molded bar grip member based strain relief system 1 and a multiconductor flat or ribbon cable with a wire conductor dropout loop based termination system 2 are shown in a cable termination assembly 10. The cable termination assembly 10 includes a cable termination 11 and a multiconductor electrical cable 12.

Various types of cables 12 may be used. One type is a ribbon cable; it includes a plurality of wire conductors 13 and electrical insulation 14. According to the preferred embodiments of the invention, the cable 12 is of the Teflon ribbon cable type or of the woven cable type. An example of Teflon ribbon cable is found in U.S. Pat. Nos. 3,082,292 and 3,540,956 and an example of woven cable is found in the above-mentioned Ross patent. The features of the invention also may be used with other types of cable, such as those ribbon cables that use other types of plastic or like insulation materials, coaxial, triaxial, etc. cables or a parallel arrangement of several coaxial, triaxial, etc. cables, and so forth. Moreover, features of the invention may be used, too, with optical cables, e.g., for providing strain relief and termination functions therefor. The invention will be described hereinafter with respect to generally flat, ribbon-type multiconductor Teflon cables and woven cables.

The cable termination 11 includes an end cap 15 having a front wall 16 with one or more openings 17 for access to electrical contacts (not shown in FIG. 1) in chambers (also not shown in FIG. 1) within the end cap. The shape of the opening(s) 17 and the style of the contacts will depend on the type of external member, e.g., pin contacts or other male contacts, female contacts, terminal pads on the edge of a printed card, etc., to which the cable termination assembly is intended for connection. In one embodiment the contacts are electrically connected to respective conductors 13 via an interface provided by a printed circuit board, and in another embodiment the contacts are directly connected to respective conductors 13. The cable termination 11 also includes a cover 20 formed by upper and lower cover halves 21*a*, 21*b*, which preferably are identical. The cover halves may be secured to each other by fasteners 23, such as screws or rivets, to form with the end cap 15 a housing 24 for the contacts, part of the cable 12, and connections between the cable and contacts. In the embodiment using a printed circuit board interface between the contacts and the conductors 13, the cover 20 is pre-formed, e.g., by plastic injection molding, and it is attached to the end cap 15 by locking tabs 25, which fit into locking recesses 26 that are located at the opposite edges of the end cap 15. In the embodiment wherein the contacts and conductors are directly engaged and connected, the cover 20 may be molded directly to the end cap 15, cable 12, and connections between the contacts and conductors 13.

Using the cable termination assembly 10, the assembly is positioned relative to another cable termination assembly, receptacle, terminal board, etc., which has some type of member (sometimes referred to as an external member), such as a pin contact or other type of contact or terminal, so that such member will slide into openings 17 in the end cap 15 to engage respective contacts in the end cap, thus effecting electrical connection with the respective conductors 13. Although the invention is shown and described using male pin contacts inserted into the end cap 15 to engage some type of mating contact therein, other types of contact arrangements may be employed. For example, the contacts employed in the end cap 15 may be male contacts and those to which such male contacts are connected may be female or other types of contacts in which case the form of the end cap 15 may vary, as is conventional. Similarly, the cable termination assembly 10 may be a card edge connector with contacts that connect with terminal pads on a printed circuit card. These are only several examples, and it will be appreciated that the invention may be used for other connections and devices, too.

When the cable termination assembly 10 is installed in the manner just described and/or when it is removed from such connection, as well as at other times, it is possible that force may be applied that would tend to pull the cable 12 away from the cable termination 11. It is conventional to provide a strain relief to try to prevent that force from affecting the connections between the conductors 13 and the contacts, interface circuit board, etc., within the cable termination 11. The invention includes a novel strain relief system 1.

Turning, now, to FIG. 2, an exploded fragmentary isometric view of the cable termination assembly 10 provides a schematic illustration of a number of the features of the invention.

Strain Relief System 1

The strain relief system 1 includes a strain relief bar 31, which is secured to the cable 12, and a strain relief recess generally indicated at 32 in the housing 24. The bar 31 fits in the recess 32 in a relatively close fit relation so that force tending to move the cable relative to the housing, for example pulling the cable away from the housing or vice versa, is transmitted between the cable and the housing via the strain relief bar 31 and walls of the housing that form the recess 32.

A connection mechanism 33, e.g. using a printed circuit board interface or a direct connection as are described further below, connects the cable conductors 13 at a connecting portion 34 of the cable ultimately to electrical contacts, one of which is shown at 35 in FIG. 2. The connection mechanism 33 typically is located in the housing 24, and it is the purpose of the strain relief system 1 to prevent transmitting force that is applied to the housing 24 and/or to the cable 12 from applying a force to the connection mechanism 33 that would tend to open, break, or otherwise detrimentally affect connections made there.

Preferably the strain relief bar 31 is made of plastic or plastic-like material or of a material that can be formed preferably by molding technique, especially by plastic injection molding. The bar 31 may be made of other material and/or by other techniques so as to provide the desired features described herein. To form the bar 31 on the cable 12, a portion of the cable is placed in the mold of a plastic injection molding machine. A core, which forms the recess 36 in the bar 31, spaces the cable away from one side of the mold, e.g., approximately centering the cable in the mold cavity, and preferably plastic is injected into the mold from the other side so that the entire bar is molded directly to the cable while the cable remains substantially centered between the two sides of the mold with portions of the bar 31 on both sides of the cable and also overlapping the edges of the cable, as is illustrated in FIGS. 2, 3, 6, 7–10, 20, 23, and 24.

Some of the description and reference to drawing figures will jump from time to time from the main drawing figure being described to a later drawing figure in order to demonstrate relationships of the various principles and features of the invention in the several embodiments of cable termination assembly in accordance with the invention. A detailed description of each drawing figure, though, will be presented in serial sequence.

Figure 16:
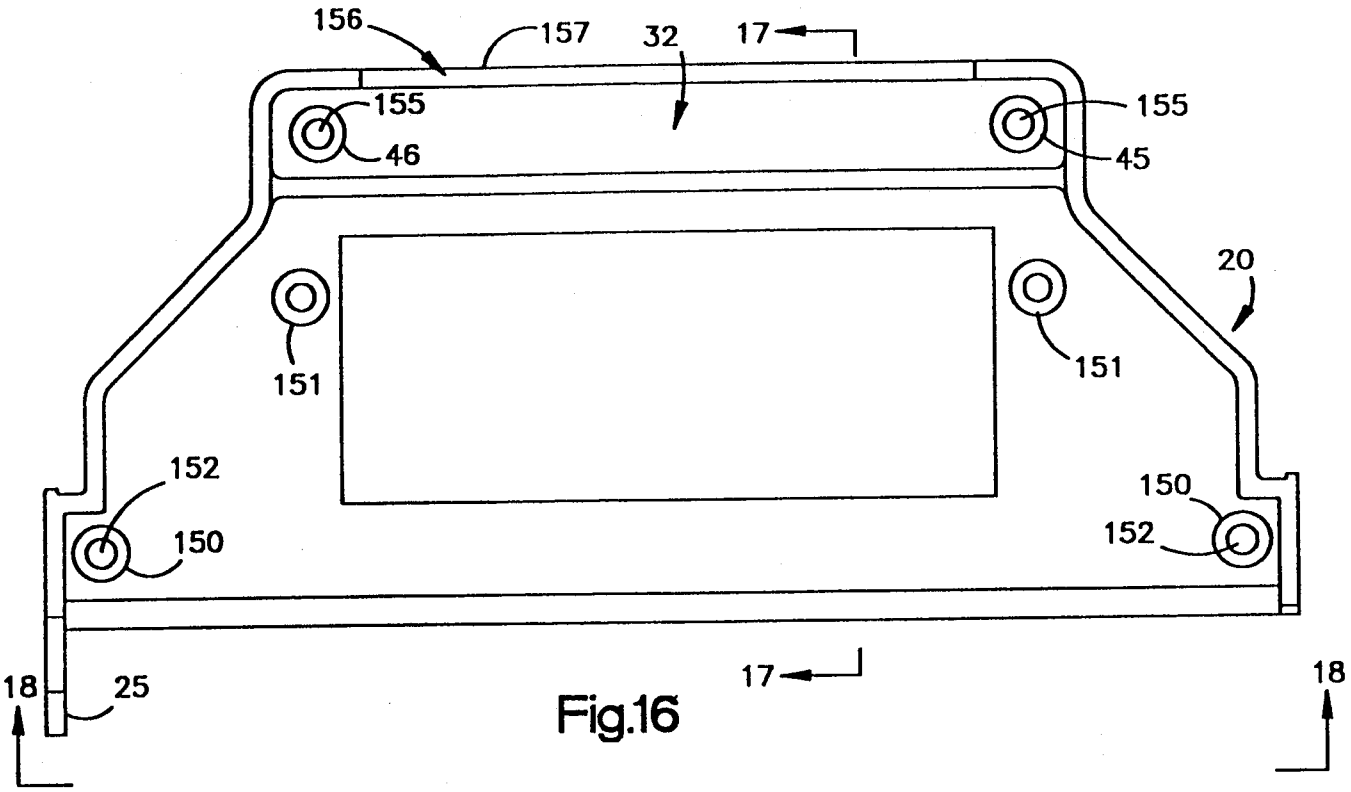
FIG. 16 is a plan view of the inside of a representative cover used to form the housing of the cable termination assembly of FIG. 1.

When the cable 12 of FIG. 2 is of the woven type and the strain relief bar 31 is molded to such woven cable 12W (see FIG. 6), the plastic molding material will tend to permeate through the cable weave to penetrate the various interstices, volumes, areas, etc. that exist in the weave or fabric of the cable so that the strain relief bar 31 is very securely attached to the cable and will not slide along the cable. Some of the plastic material actually may penetrate through the weave from one side of the cable to the other, i.e., from one planar surface to the other (top to bottom, etc.), thus further securing the bar 31 to the cable. Due to the undulations in the conductors and threads of the woven cable, it is difficult, sometimes impossible, completely to close the mold cavity over the cable during the process of molding the bar to the cable. Therefore, it is possible that there would be some flash material or flashing schematically depicted at 37 in FIG. 6, for example, formed by molding material that exits the mold cavity where there is not a close seal or closure with respect to the cable. An advantage to the present invention is that such flashing 37 will not detrimentally affect the strain relief system 1 because the walls of the cover halves 21*a*, 21*b* (FIG. 2) bounding the recesses 32 therein provide adequate space for such flashing. The walls 40, 41 bounding the forward and rearward portions of the recess 32 and the forward and rearward walls 42, 43 of the strain relief bar 31 preferably fit in relatively close relationship so that the strain relief bar 31 will not slide forward or back in the recess 32. The recess 32 also has bottom and edge wall portions 44, 45, 46 (also see FIGS. 16–18) which prevent movement of the strain relief bar 31 in other directions.

Figure 7:
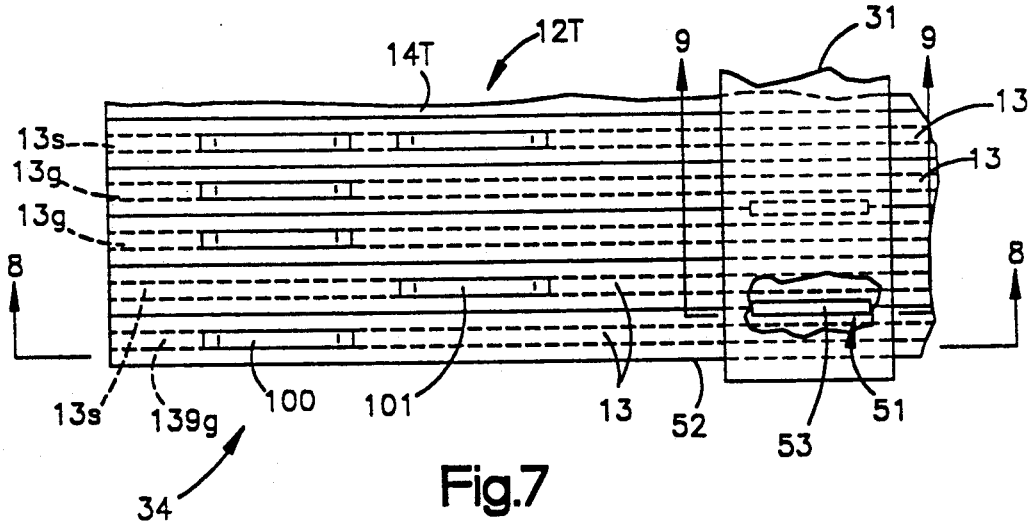
FIG. 7 is a fragmentary top plan view of a Teflon cable prepared for use and useful in the cable termination of FIG. 1 and also employing a strain relief bar.
Figure 8:
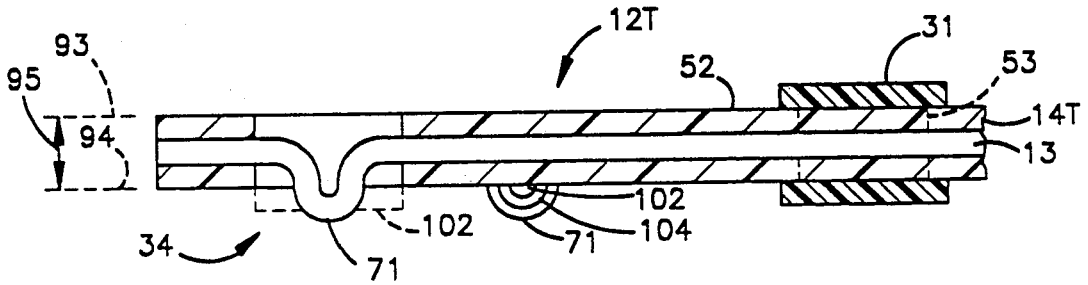
FIG. 8 is a section view looking into the edge of the cable generally in the direction of the arrows 8—8 of FIG. 7.
Figure 9:
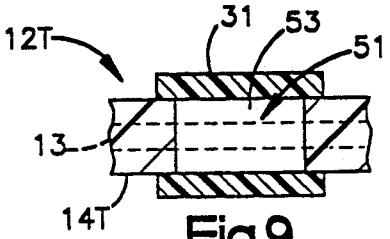
FIG. 9 is a fragmentary section view of the cable and strain relief bar looking generally in the direction of the arrows 9—9 of FIG. 7.

An advantage to the strain relief system 1 using the strain relief bar 31 is that the system can be essentially uniform for use with virtually any multiconductor ribbon cable. For example, the cable 12 may be a Teflon type multiconductor ribbon cable 12T, which is illustrated in FIG. 7, and the strain relief bar 31 also may be molded thereto. In such Teflon type cable 12T (FIG. 7) a plurality of openings 51 are formed through the Teflon insulation material 52, and the strain relief bar 31 is molded so that tab-like legs 53 extend through such openings 51 to secure the bar to the cable. The openings 51 may be formed by conventional cutting technique with a knife, punch, die or the like, or they may be formed using laser techniques to burn away part of the Teflon material. Preferably there are a plurality of openings 51 across the width of the Teflon cable 12T, and preferably there is a leg 53 in each, as also is seen in FIGS. 8 and 9.

The strain relief bar also may be used with other single and multiconductor cables, too, generally in the several ways described herein and in equivalent ways. Further, if the cable insulation and the strain relief bar material are compatible, chemical or other bonding technique may be used to secure the strain relief bar to the cable.

Preferably the strain relief bar 31 has edge portions 54, 55 (FIGS. 2 and 3), which extend or overlap beyond the edges 56, 57 of the cable and lock the top and bottom parts 21*a*, 21*b* to the cable. The edge portions 54, 55 also cooperate with wall portions 45, 46 in the recess 32 (FIGS. 16–18) to prevent lateral or side-to-side movement of the strain relief bar in the recess, thus further helping to assure that forces and relative movement of the cable 12 and housing 24 will not be transmitted to the connection mechanism 33 in the housing.

Figure 24:
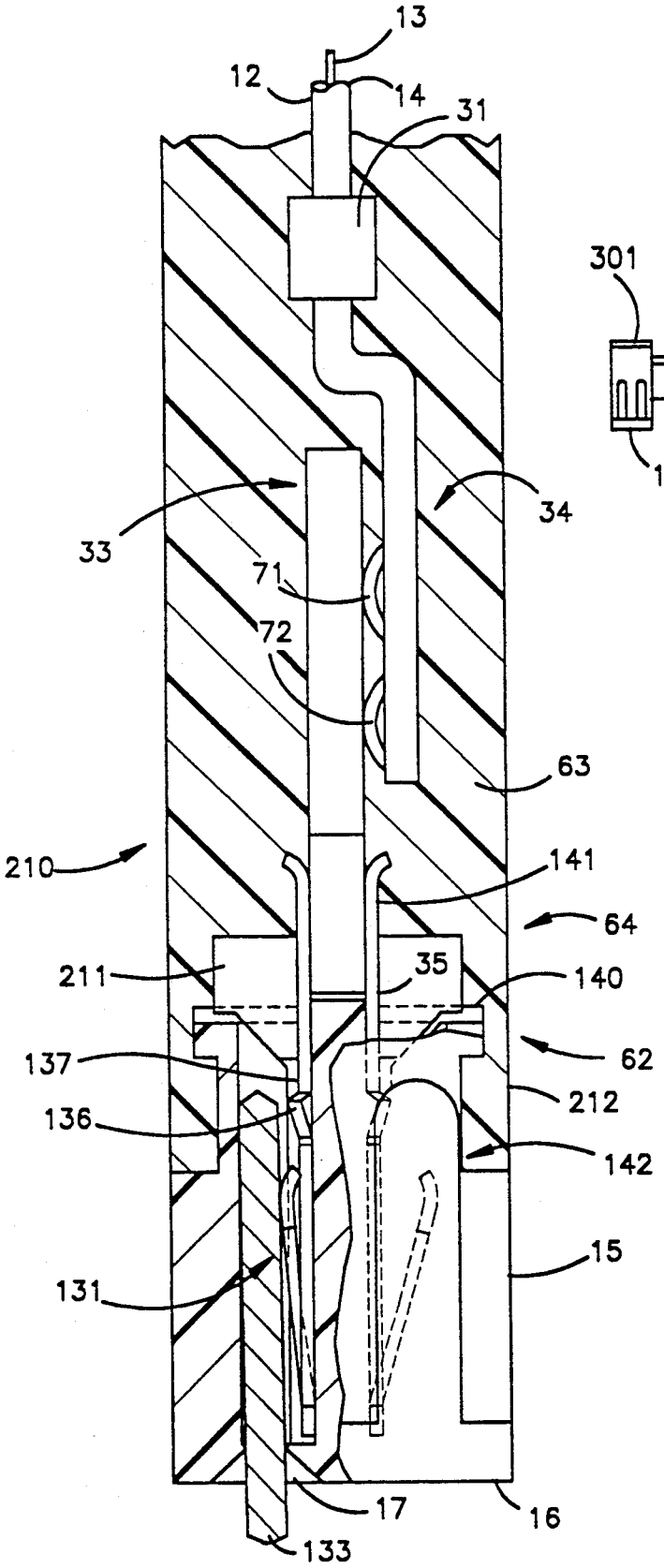
FIG. 24 is an edge elevation view, partly in section, of another alternate embodiment of the invention using a directly molded strain relief body integrally molded to various portions of the cable termination assembly including the end cap, contacts, printed circuit board, cable, and strain relief bar.

Briefly referring to FIG. 24, another indication of the versatility of the strain relief system 1 in accordance with the present invention is illustrated in an alternate embodiment of cable termination assembly 62. A molded body 63 (also sometimes referred to as a strain relief body), for example of plastic or other electrically insulating material is directly molded to and, thus, is connected to the end cap 15, contacts 35, connection mechanism 33, and connecting portion 34 of the cable 12. The molded body 63 and the end cap 15 form the housing 64 for the assembly 62. The strain relief bar 31, which is attached to the cable 12 also is secured in place; the housing 64 being molded within the body 63, which forms a natural recess about and containing the strain relief bar 31. Force applied to the cable 12 or the housing 64 tending to separate them will be transmitted via the strain relief bar 31 and will not be transmitted to the connection portion 33.

An advantage of using a strain relief system 1 that employs a strain relief bar 31 or equivalent that can be secured in a cable termination assembly housing is that such bar may be formed at periodic locations along the axial length of a cable 12 as part of a standard manufacturing process. Those locations may be spaced equidistant amounts or they may be unequally spaced. The cable with the strain relief bar may be stored on a spool or may be otherwise stored. Then, when it is desired to make a cable termination assembly of a prescribed length, the desired length of cable can be cut from the stored cable, and the cable termination 11, 62, etc. of the various types disclosed herein, may be attached to the cable proximate a strain relief bar 31 that already exists on the cable.

Figure 20:
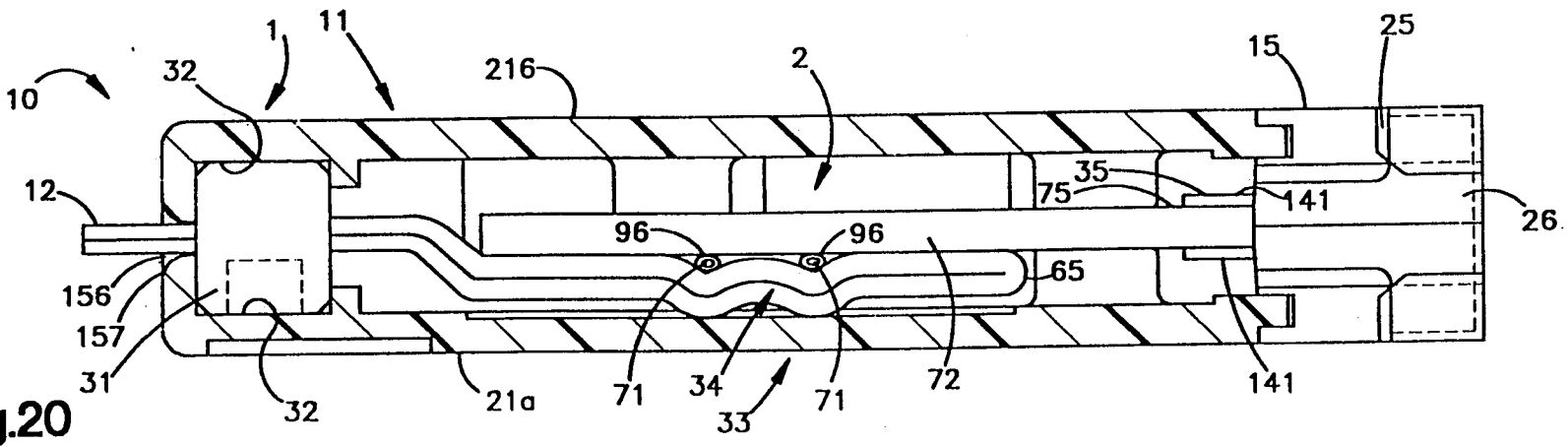
FIG. 20 is an edge elevation view, partly broken away in section, of the cable termination assembly of FIG. 1.
Figure 23:
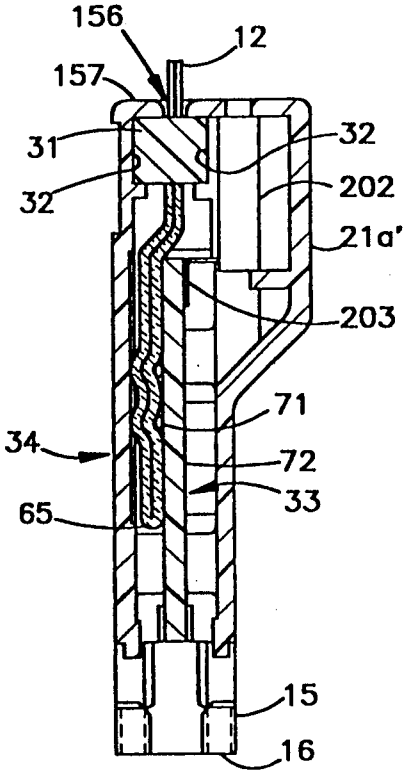
FIG. 23 is an edge elevation view partly in section looking generally in the direction of the arrows 23—23 of FIG. 21.

Briefly referring to FIGS. 20 and 23, the strain relief bar 31 is used in a strain relief system 1 of a respective cable termination assembly that is configured as a bus or daisy chain type. The cable 12 both is terminated at the cable termination and also continues to connect to another member (not shown). Thus, the cable is folded at 65 and both enters and exits the respective cable termination. In these embodiments the strain relief bar 31 is molded to both the entering and exiting cable portions. Alternatively, the strain relief bar 31 may be molded to only one of the cable portions, or a separate strain relief bar 31 may be molded to each cable portion; the recess 32 would be configured to receive and to hold the particular strain relief bar(s) used.

It will be appreciated that the strain relief system 1 of the invention may be employed with virtually any type of cable termination.

The Cable Termination System 2

To terminate a conductor (or more than one conductor) 13 of the cable 12, a loop-like dropout portion 71 of the conductor is exposed out of the major or average planar extent of the cable in the manner illustrated in FIG. 2, for example. The actual shape of the loop 71 may be curved at a greater or lesser radius of curvature. Alternatively, the shape of the loop 71 may include distinct bends, such as right angle bends or some other angular bend relationship between adjacent portions ultimately that form more or less a shape similar to the loop 71 illustrated in FIG. 2 and elsewhere in the drawings. The loop 71 includes at least a portion of the conductor 13 designated 13*a* at the loop, which is exposed from insulation 14 and any other insulation. Therefore, the conductor portion 13*a* can be electrically connected to another electrically conductive member, for example, by direct engagement with such other member and/or by attachment to such member. Attachment may be provided by means of soldering, welding, gluing, or some other attaching technique that holds the portion of conductor 13 and the other conductive member in physical engagement or connection and in electrically conductive relationship.

In the embodiment illustrated in FIG. 2, the cable termination system 2 also includes a printed circuit board 72 to interface physically and electrically between the conductors 13 and the contacts 35. Terminal pads 73 of electrically conductive material on the board 72 are connected to respective conductor loops 71. The terminal pads 73 are coupled by conductive paths 74 to further contact terminal pads 75 to which the respective contacts 35 are connected, as by touching, soldering, adhesive, welding, etc. Thus, through the mechanical and electrical interface provided by the printed circuit board 72 the conductors 13 are coupled electrically to the respective contacts 35 for making electrical connections to external members to which the cable termination assembly 10 of the invention is intended to be connected.

Figure 3:
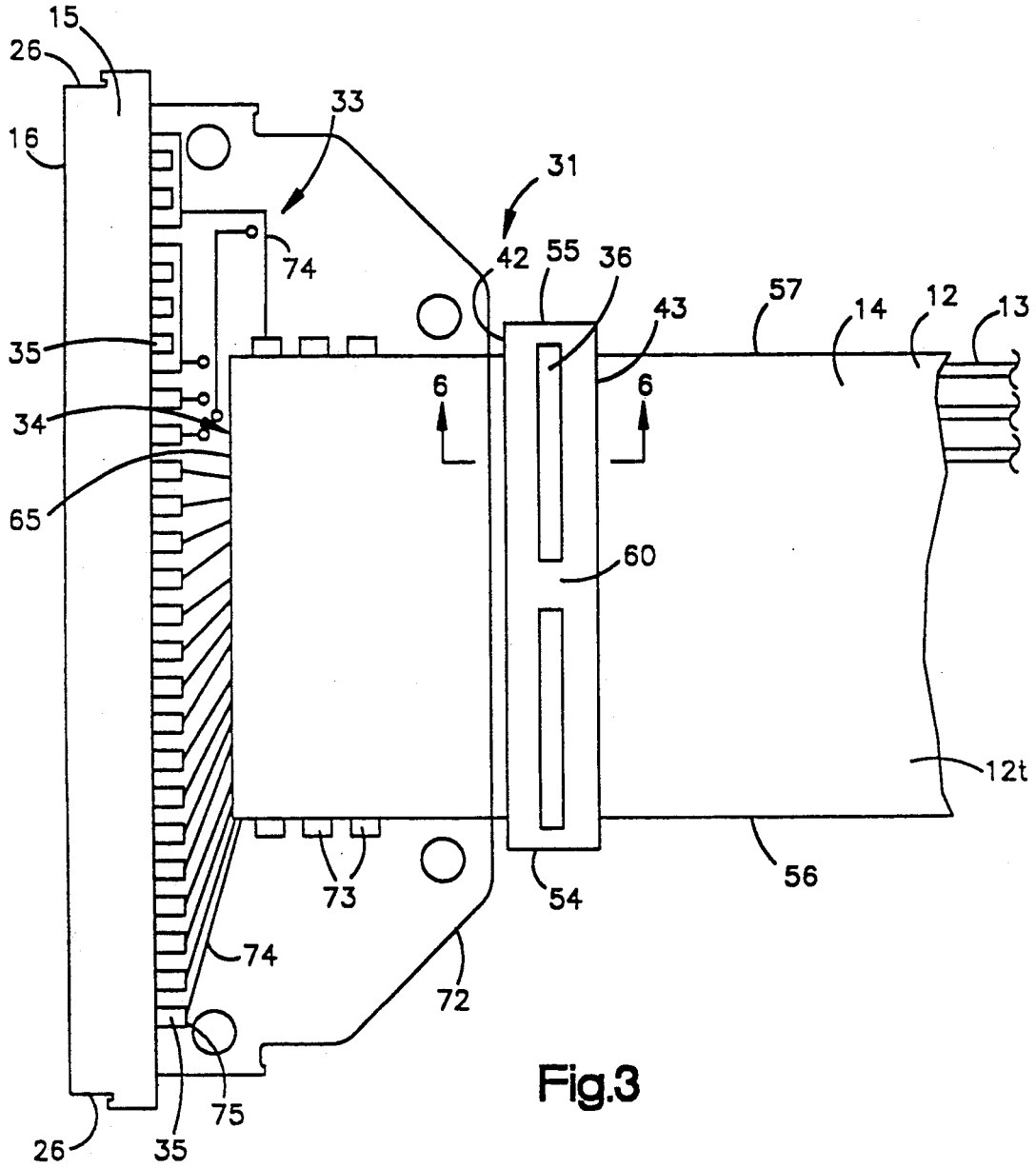
FIG. 3 is a top plan view of the cable termination assembly of FIG. 1 with the cover removed.

There are several advantages to using a printed circuit board interface 72 or like interface device, as is seen, for example, in the several other drawing figures. One example is the ability to fan out from the spacing of the conductors in the cable 12 to a different spacing arrangement of the contacts 35, as is depicted in the illustration of FIG. 3. Usually the diameter of the conductor 13 and the spacing between conductors is significantly smaller than the size and spacing of the contacts 35. Another advantage is the ability to change relative locations whereby, for example, two conductors 13 that are adjacent each other in the cable 12 actually may be coupled to contacts that are positioned in the end cap 15 at different relative locations, e.g., on opposite surfaces of the circuit board 72, at different lateral locations on the circuit board 72, etc., by using through-the-board circuits (e.g. plated through holes) and arrangement of conductive paths 74 on the printed circuit board 72, as is known. A further advantage is the ability to provide shielding, grounding, a source of ground reference potential, etc., from the conductors 13 all the way to the contacts 35 by appropriately designing the conductive paths on the printed circuit board 72. Even another advantage of using a circuit board interface is demonstrated by the embodiment illustrated in FIGS. 21–23 that enables merging in the cable termination assembly signals that are received from a source outside the cable termination assembly other than the external member to which it ordinarily is intended to be connected via the front of the end cap 15 and contacts 35 therein, as will be described further below.

Briefly referring to FIGS. 26–29, an alternate form of cable termination system 2 is illustrated. Here the conductor loops 71 are directly connected to contacts 35 without using a circuit board interface.

The loops 71 in the cable termination system 2 may be located in a cable connection portion 34 at an end of the cable or at an intermediate portion of the cable, as is seen in the several embodiments hereof. The conductors 13 of the cable may be intended only for carrying signals, such as digital signals or even analog signals, or a number of the conductors 13 may be intended to provide a source of reference potential, such as ground reference potential, to provide shielding, minimization of cross talk, impedance matching, and/or other characteristics that are especially desirable in a cable intended for high speed signal transmission purposes.

Figure 4:
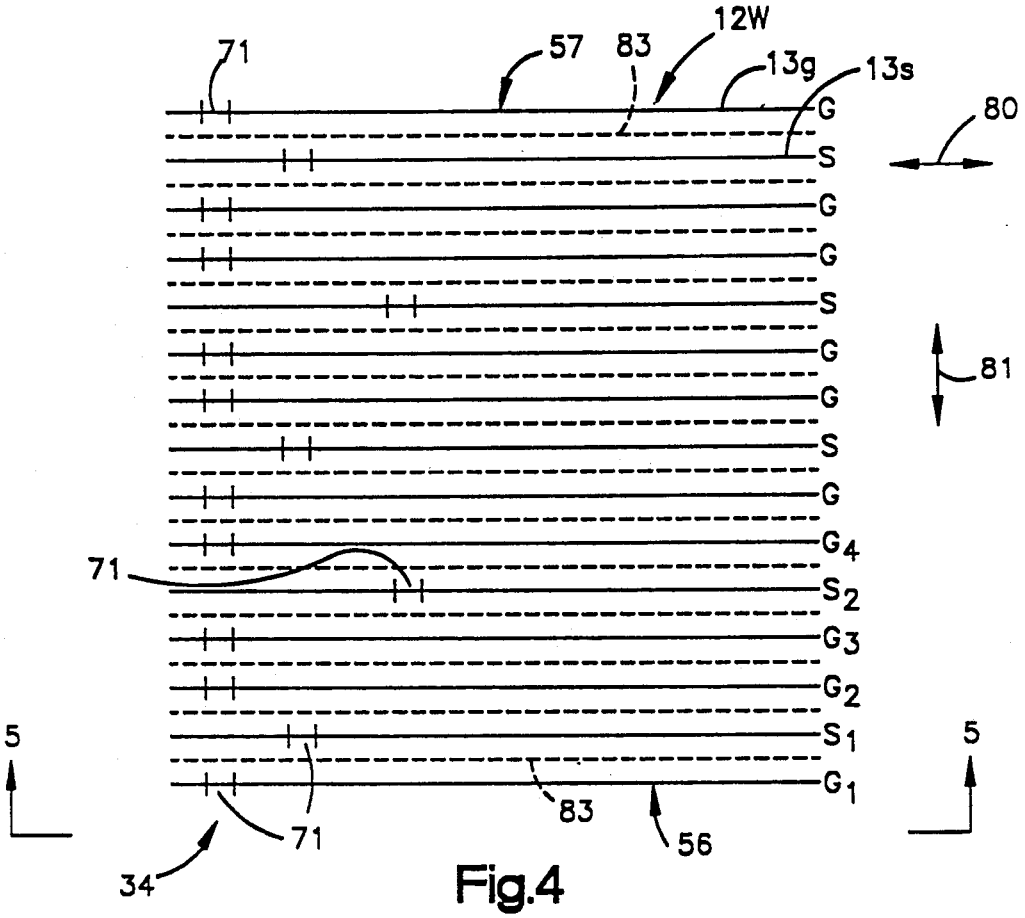
FIG. 4 is a top plan view of a schematic representation of a fragment of a woven electrical cable useful in one embodiment of the cable termination assembly of FIG. 1.
Figure 5:
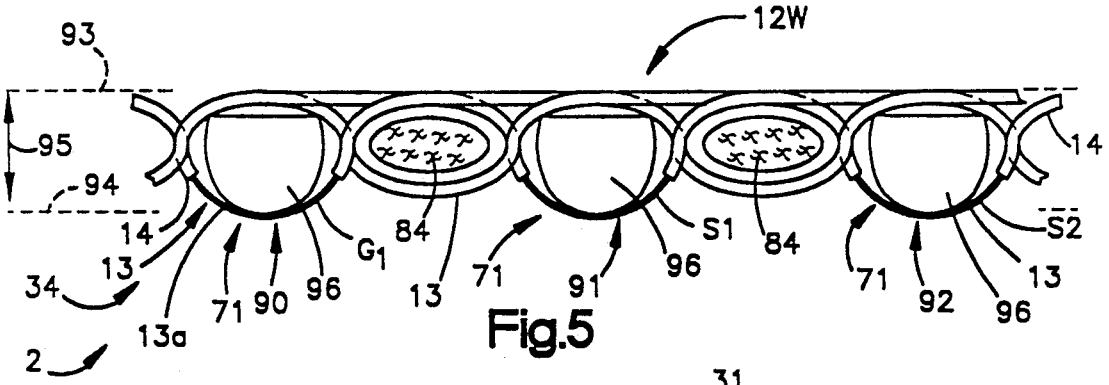
FIG. 5 is an enlarged fragmentary edge view of the woven cable of FIG. 4 showing loop-like connection portions of respective conductors.
Figure 6:
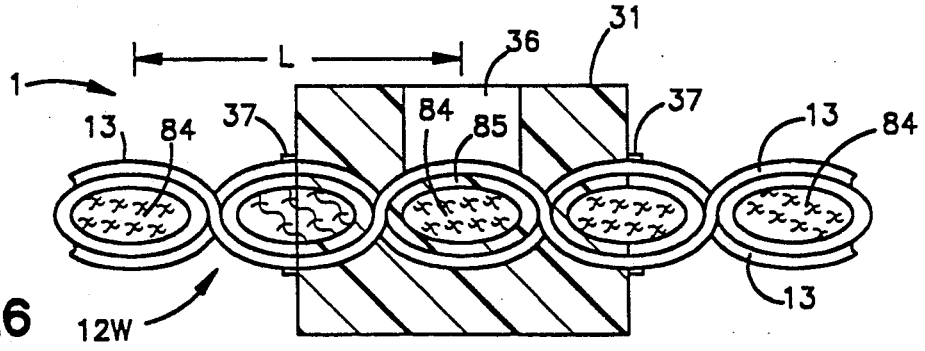
FIG. 6 is an enlarged fragmentary section view looking generally in the direction of the arrows 6—6 of FIG. 3 to show the cable and strain relief bar thereof.

In respective embodiments of the cable termination assembly 10, the cable 12 may be woven, as is represented at 12W in FIGS. 4–6, or it may have a solid insulation portion 14, especially of Teflon or like "slippery" difficult-to-bond-to material, as is represented at 12T in FIGS. 7–9. Turning to FIGS. 4–6, part of a woven cable 12W for use in cable termination assembly 10 as cable 12 thereof is shown in detail. The woven cable 12W is exemplary of one type of woven cable. It will be appreciated that other types of woven cable may be employed. In FIG. 4 is an exemplary layout of the signal 13*s* and ground 13*g* conductors for the cable 12W; and in FIGS. 5 and 6 are schematic illustrations of the cable 12W looking in from an edge 56, for example.

For convenience of description the cable 12 has a length or an axial length generally in the direction of the arrow 80, a width generally indicated in the direction of the arrow 81 (such width being between the edges 56, 57), and top and bottom surfaces 12*t*, 12*b*. The arrow 80 also designates the axis or axial extent of the cable 12, and it will be appreciated that such axial extent may be straight, bent, curved, sinuous, folded, etc., as is well known in that cables usually have some degree of flexibility and can be bent to desired shapes. Directions, such as up, down, left, right, top, bottom, etc., are used for convenience of description with respect to the drawings, but they are not intended to be limiting.

In the woven cable 12W there are several signal conductors 13*s*, several ground conductors 13*g*, and electrically nonconductive threads 83 positioned between respective pairs of conductors for spacing and like purposes, as known in the art of woven cable technology. The conductors 13 and threads 83 extend in the length or axial direction 80 at the cable, which also is referred to as the warp or warp direction of the cable, warp being a known term used in the art of weaving. In the illustrated embodiment each signal conductor 13*s* has a separate pair of ground conductors 13*g* dedicated thereto for providing signal isolation, impedance matching, etc. therefor. Thus, between adjacent pairs of signal conductors 13*s* there will be two ground conductors 13*g*, as is seen in FIG. 4. When looking in the direction of the arrows 5—5 in FIG. 4, one sees two signal conductors $S_1$ and $S_2$ with a respective pair of ground conductors $G_1$–$G_4$ on both sides of each of those signal conductors. It will be appreciated that other arrangements of ground and signal conductors, solely signal conductors, etc., may be employed in the cable 12W consistent with the principles and features of the present invention.

Briefly jumping to FIG. 6, in the art of weaving it is conventional to place a thread 84 in the weft or weft direction, usually across the width 81 of the woven material or fabric. The weft threads 84 are seen in FIG. 6 located between various undulations of the conductors 13 and warp threads 83 that are woven therewith. In the illustrated embodiment the warp threads 83 and the weft threads 84 are electrically nonconductive material; they may be natural or artificial fiber or other thread material.

The strain relief bar 31 also is seen in FIG. 6. Particularly, the penetration of the material of which the bar 31 is made into the fabric weave of the cable 12W is seen at 85. Such penetration helps to secure the bar 31 to the cable and to avoid any movement of one with respect to the other.

As the cable 12W is woven in a conventional weaving machine, one or more of the conductors 13 (usually being insulated by insulation 14) and threads 83 are moved up and down to form the generally sinusoidal or undulating pattern schematically illustrated in FIG. 6, and simultaneously the weft threads 84 are inserted in the weave so that the various undulations hold the weft threads in place. The pitch or pick length of the undulations is analogous to the wavelength of an AC electrical signal, light, etc. At the left side of FIG. 6, for example, a pitch length L for a signal conductor 13" is represented. The signal conductor 13" is illustrated as having a constant pitch, insofar as it is seen in FIG. 6, such conductor being woven about or undulating between each and every weft thread 84. However, it will be appreciated that one or more conductors and/or warp threads 83 may be woven in various other patterns, e.g., undulating or passing between every two pairs of weft threads 84 in which case the pitch length L would be double that illustrated in FIG. 6. Other types of weave patterns also may be used. Further, the weave pattern may be different at different portions in the cable, all of which is known in the art of woven cable technology.

The manner in which the loops 71 of conductors 13 are formed in the woven cable 12W is depicted schematically in FIG. 5 for a uniformly woven cable of the type illustrated in FIG. 6 wherein each conductor undulates between every pair of weft threads 84 with the exception of the areas 90, 91, 92 where respective loops 71 are to be formed. At least part of each conductor 13 is exposed from the insulation 14 where the loops are located in the cable 12 to form the cable connection portion 34. In the process of weaving the cable 12W, the normal weaving process may be interrupted at respective areas 90, 91, 92 using manual or automated control techniques available in weaving machines, so that only selected conductors 13 that are to have loops 71 established at that area in the cable actually undulate in one direction while the other conductors undulate in the opposite direction. The undulations are generally between the upper plane 93 and lower plane 94 of the cable in the direction 95 defining the usual thickness dimension of the cable, as it is illustrated in FIG. 5. The loops 71 at respective portions 90, 91, 92 are intended to extend further below the lower plane 94 of the cable for exposure and subsequent connection.

To form the loops 71 at the portions 90, 91, 92 of the woven cable 12W, inserts, spacers, picks, etc. 96 are inserted into the weave in the weaving machine in place of (or possibly in addition to) the weft thread 84. The insert 96 preferably is relatively rigid and it has a diameter of thickness in the direction of the arrow 95 which is adequate to assure that the respective loops 71, especially the exposed electrically conductive portions 13*a*, will be exposed for connection purposes as is elsewhere described herein. Such connection may be, for example, via an interface printed circuit board 72 as in FIG. 2, directly to the contacts 35, as in FIG. 26, etc. Preferably the thickness of the inserts 96 is adequate to assure that the loops 71 extend beyond the lower plane 94 of the cable for maximum exposure and availability of the loop for connection, as may be desired. However, it also is possible that the thickness of the inserts 96 may be of lesser extent, and the loops 71 may actually be arranged so that they do not extend further beyond the bottom plane 94 so long as they are adequately exposed and cooperatively related to that to which they are intended to be connected so that electrical and/or mechanical connection can be made with respect thereto.

In a woven cable 12W each conductor 13 usually has its own electrical insulation surrounding it. To expose the conductor 13 from such insulation, various techniques may be employed, such as conventional stripping, laser stripping, abrasion, and/or other techniques. Laser stripping is preferred, such stripping being performed after the cable is woven and the loop 71 formed. However, it may be possible to perform the stripping at other times during the process of manufacturing the cable.

As is seen in FIG. 4, loops 71 are formed in various conductors 13 at selected locations along the length 80 of the cable 12W. The actual locations of those loops may be determined by selective programming of the weaving machine so that at the location along the length of the cable where a loop is to be formed an insert 96 is placed and only the conductor(s) in which a loop is to be formed would be bent or undulate about that insert to form the loop 71 in the manner illustrated in FIG. 5. The front-most portion of the cable 12W connection portion 34, i.e., that portion which is closest to the contacts 35 in FIG. 1, appears to the left as viewed in FIG. 4. The loops 71 in the ground conductors 13*g* are at the forward-most location in the cable, whereas the loops 71 for the signal conductors 13*s* are more to the right. Therefore, the shielding or grounding function provided by the ground conductors 13*g* is provided along the maximum length of the cable and, in particular, beyond the location where the signal conductors typically are terminated to the circuit board 72. Grounding/shielding of signals as they are conducted along the circuit board 72 by respective conductive paths 74 may be provided on the circuit board itself by conventional means, such as ground signal paths, etc. This configuration optimizes the shielding of the signal conductors, minimizes cross talk, and maximizes the integrity of the signals carried thereby.

Although the loops 71 preferably are formed in the manner described above at the locations described above, other means may be employed to form the loops. Also, the relative locations of the loops 71 along the length of the cable 12W may be altered, as may be desired. Further, if it is desired, a particular conductor 13 may be terminated at more than one loop 71, for example, when a signal conductor 13*s* is intended also to serve as a ground conductor and would be terminated both where the loops terminate all the ground conductors 13*g* as well as at an appropriate loop located more to the right of the forward-most end of the cable.

Turning to FIGS. 7, 8 and 9, a multiconductor ribbon cable 12T that has the conductors 13 in a substantially solid insulation containment mechanism, as is conventional, is illustrated. In the preferred embodiment the insulation 14T (the suffix "T" indicating Teflon or similar insulation) is Teflon or some other material to which bonding, for example by plastic injection molding of the strain relief bar 31, typically is difficult, if not impossible. However, use of tab-like legs 53 in opening 51 in the insulation enables attachment of the strain relief bar 31 to be secured to the cable 12T, as was described above.

To form the loops 71 for the conductors 13 in the cable 12T, electrical insulation is removed from the cable at selected locations 100, 101. Such insulation may be removed by laser stripping, cutting or burning, punching, die cutting, abrading, or other technique. With the insulation 14T removed from respective areas 100, 101, the actual conductor wire 13 may be pressed downward relative to the illustration in FIG. 8 to form the loop 71. The thickness of the cable insulation is seen in FIG. 8 as represented by the arrow 95 between the upper and lower planes 93, 94, and preferably the loop 71 extends below the lower plane 94 for exposure to make connection therewith in the manner described above.

In one embodiment the insulation 14T is scored or cut at an area 100, 101, where a conductor loop 71 is to be formed, and that scoring or cutting occurs in the direction that is generally parallel to the conductor both above and below the conductor, i.e. from the top of the cable 12*t* and bottom 12*b* of the cable 12. Then, by acting through the cut in the top of the cable (relative to the illustration of FIG. 8), the conductor is pressed out through the cut in the bottom of the cable to form the loop 71. Meanwhile, a substantial amount of insulation 14T remains in the vicinity of the loop 71 as an attached fragment or flap 102, although preferably the loop extends beyond (below) the bottom of that insulation, as is seen in FIG. 8. The remaining insulation 102 then helps to provide further support for the conductor wire 13 in the area of the loop 71 providing rigidity thereto. If desired, an insert 103, which is similar to the insert 96 described above with reference to FIG. 5, may be inserted in the open space 104 bounded by the conductor wire forming the loop 71 and the bottom surface of the cable 12T to provide additional rigidity for the loop. An example of how such inserts 103 and inserts 103 and inserts 96 of the embodiment illustrated in FIG. 5 would be employed is seen in FIG. 10, for example.

As is seen in FIG. 7, the arrangement of conductors 13 is similar to that described above, namely, a separate pair of ground conductors is provided on both sides of each signal conductor within the plane of the cable. Moreover, for illustrative purposes, the signal conductor at the topmost portion of FIG. 7 is shown having two loops 71 therein, one being connected in the same general area where the other ground conductors are terminated and one in the area 101 where various signal conductors are terminated. Further, from a comparison of the embodiments illustrated in FIGS. 4 and 7, for example, it will be appreciated that the number of areas along the length of the cable 12 where conductors 13 are intended to be terminated at respective loops 71 may be one, two, three or even more, three such areas being shown in FIG. 4 and two being shown in FIG. 7.

As is seen in FIGS. 7-9, the strain relief bar 31 is secured to the cable at a location near enough to the cable terminating system 70 where the loops 71 are formed to be useful to secure the cable as part of the strain relief system in the cable termination. The strain relief bar 31, though, preferably is slightly spaced from the loops 71 to avoid interfering with connection of the conductors 13 to respective further members, such as pads on a printed circuit board, contacts, etc.

Figure 10:
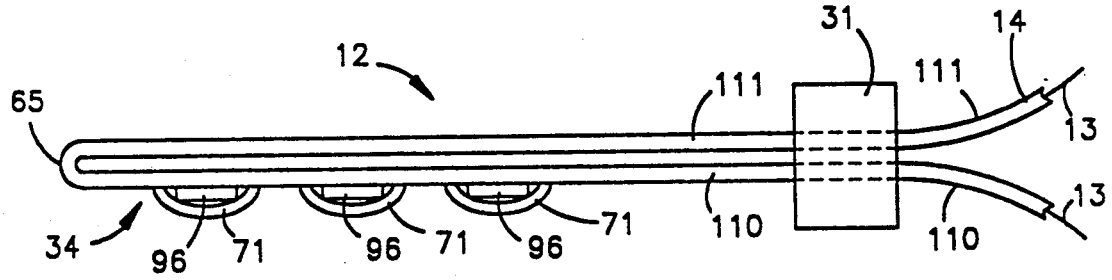
FIG. 10 is an edge view of a daisy chain configuration of cable with a strain relief bar for use in a daisy chain version of the cable termination assembly of FIG. 1.

Briefly referring to FIG. 10, the connecting portion 34 of a cable 12 is illustrated. The illustration in FIG. 10, as are a number of the other illustrations and descriptions herein, is representative of a cable 12 that may be of the woven type, Teflon type, or some other type of multiconductor ribbon cable or assemblage of conductors arranged generally in the structure of a multiconductor ribbon cable. The connecting portion 34 of the cable 12 provides for cable termination intermediate the ends of the cable. Thus, two parallel portions of the cable 110, 111 are secured in the strain relief bar 31 in one of the manners described above, e.g., for woven cable or for solid insulation cable (such as Teflon cable), and the two cable portions 110, 111 are joined at a bend or fold 65. Loops 71 that may be connected to further members, as is elsewhere described, provide for connection of the various conductors 13 of the cable without interrupting the integrity of those conductors, which may be connected to other devices via cable portions 110, 111. An advantage to the folded back portion 113 of the cable 12 above the connecting portion 34 of the cable 12 where the loops 71 are formed, is the providing of additional stiffness to the cable to facilitate connecting of and to improve the integrity of the connections made by the loops 71 to another member, such as the printed circuit board. The same advantage insofar as stiffness is concerned is obtained by the fold 65 and folded back portion 113 in the cable 12 as is illustrated in FIG. 2.

An advantage to the cable termination assembly 10 of the present invention is that the cable 12 preferably only has to be specially prepared on one side of the cable, i.e., the bottom 12*b* (FIG. 2) with loops 71 there. This facilitates manufacturing and handling. If desired, loops may be provided at both the top and bottom of the cable, e.g., as in the embodiment shown in FIG. 26.

Printed Circuit Board 72

Figure 11:
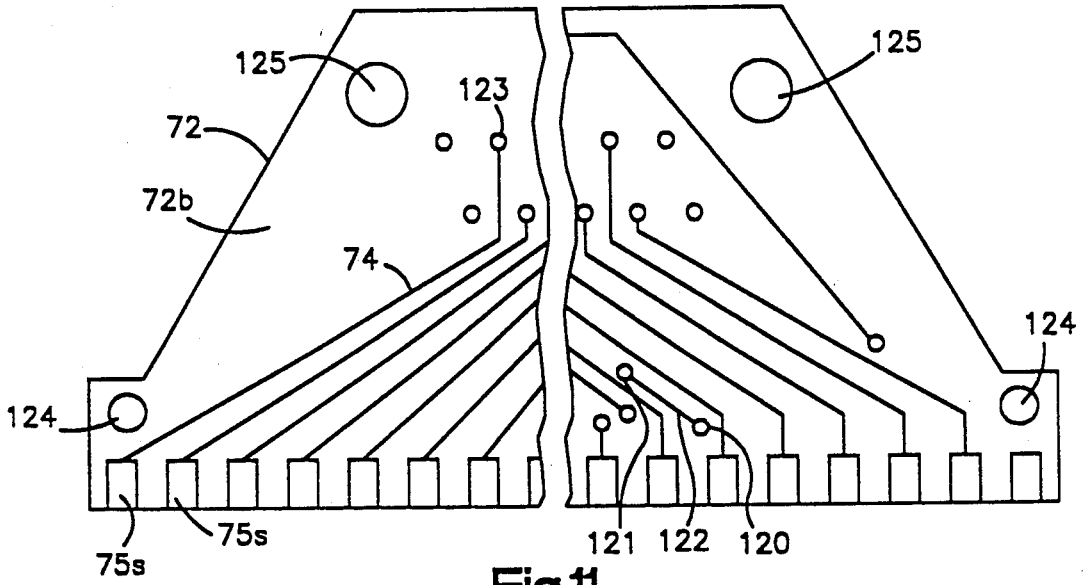
FIG. 11 is a bottom plan view of a printed circuit board used in the cable termination assembly of FIG. 1.
Figure 12:
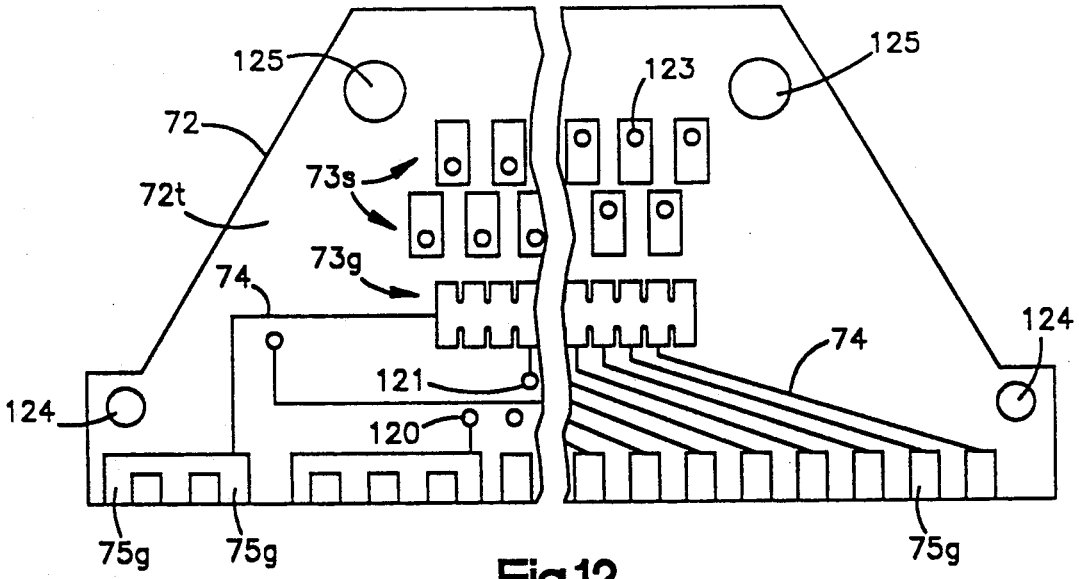
FIG. 12 is a top plan view of the printed circuit board used in the cable termination assembly of FIG. 1.

An exemplary printed circuit board 72 is illustrated in FIGS. 11 and 12. Relative to the illustration in FIG. 2, the bottom of the circuit board is shown in FIG. 11 and the top is shown in FIG. 12. On the top are a plurality of terminal pads 73*g* and 73*s*, which correspond to the terminal pads 73 of FIG. 2 for connection to respective cable conductor loops 71. The terminal pads 73*g* preferably are for the ground conductors and are located in such a manner that they all are interconnected; the terminal pads 73*s* are for the signal conductors. In the illustrated embodiment all of the ground terminal pads 73 are connected via respective printed circuit traces or conductive paths 74 to respective ground contact terminal pads 75*g*. A number of the ground contact terminal pads 75*g* may be interconnected, as is seen at the left-hand portion of FIG. 12.

It will be appreciated that the particular arrangement of terminal pads, conductive paths and plated-through holes or vias on the circuit board 72 is exemplary. Other forms may be used. Also, for increased sophistication, multi-layer boards may be used in accordance with the invention. Further, various openings 124 near the front of the board and 125 near the back of the board may be employed to facilitate mounting the board in the cover 20 of the cable termination 11 via rivets 23 (FIG. 1).

End Cap 15

Figure 13:
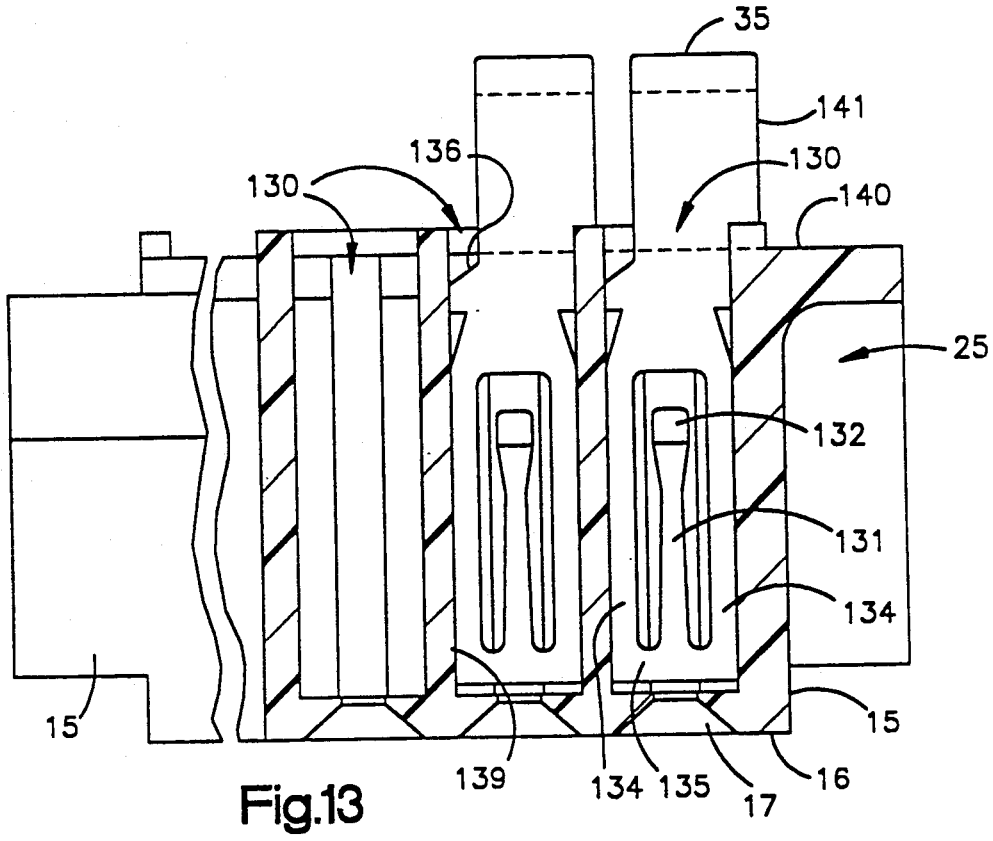
FIG. 13 is a fragmentary elevation view, partly broken away in section, of the end cap for the cable termination assembly of FIG. 1, one contact chamber being left vacant for purposes of illustration.
Figure 14:
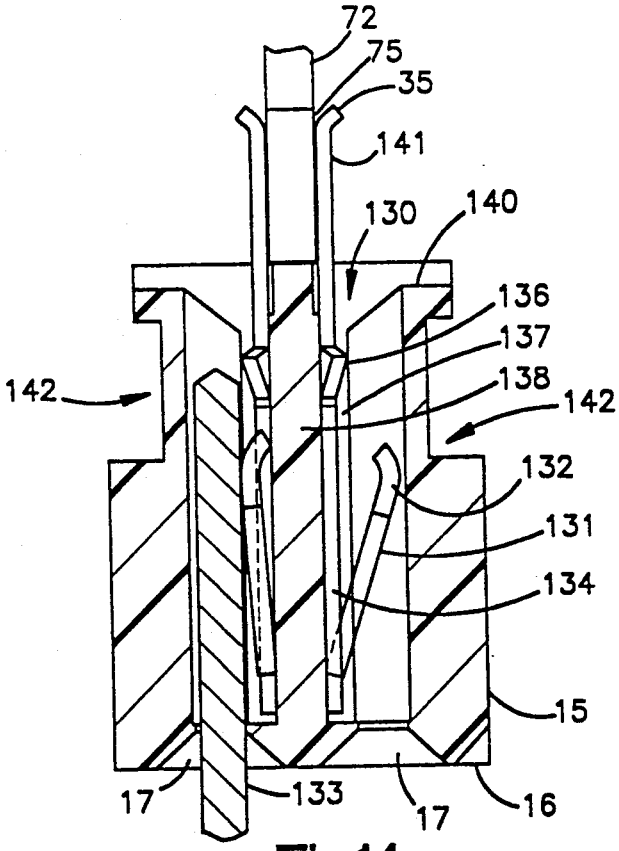
FIG. 14 is an edge view, partly in section, of the end cap of FIG. 13 with a printed circuit board attached to the back end and a pin contact inserted into one contact chamber.
Figure 15:
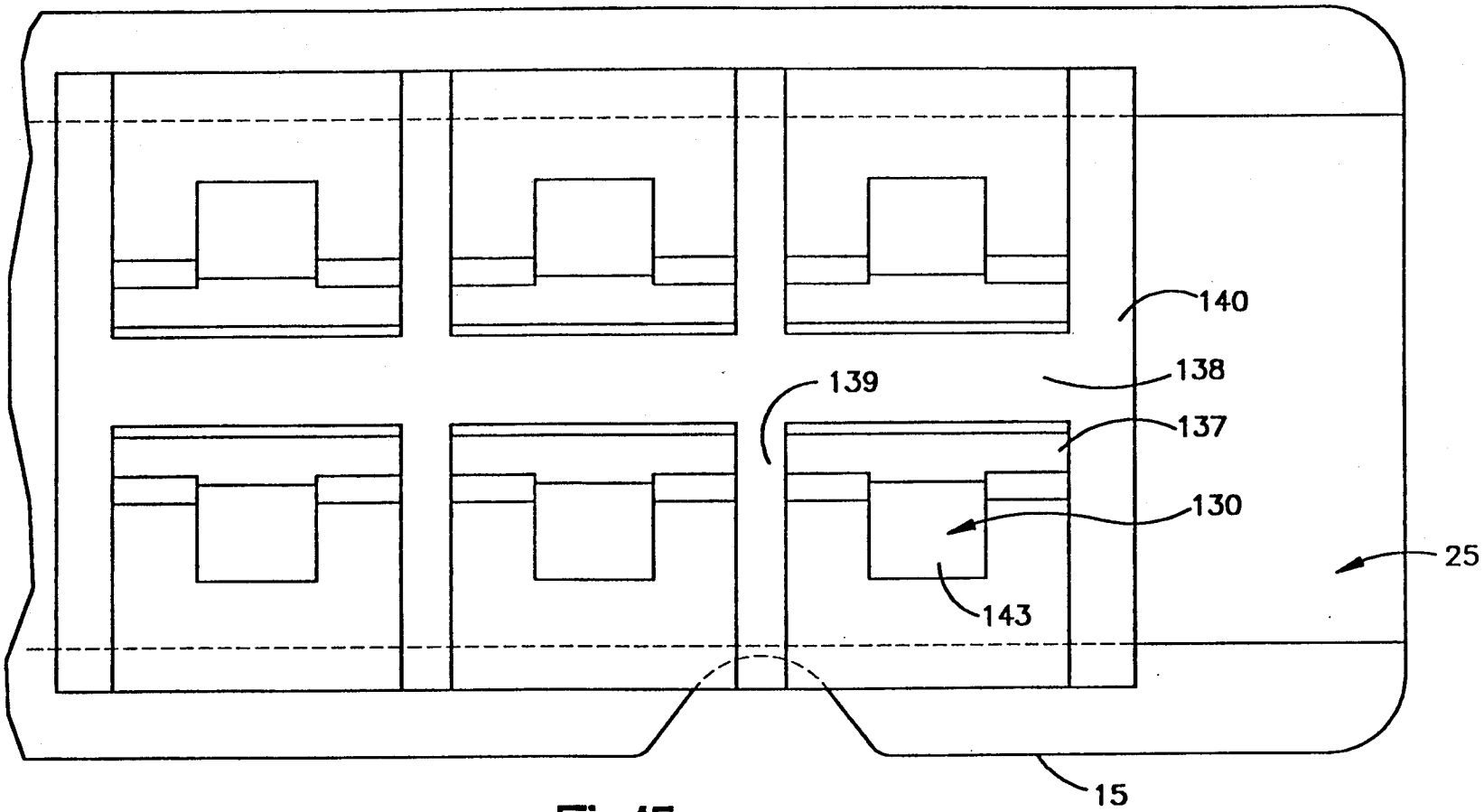
FIG. 15 is a back view of the end cap of the cable termination assembly of FIG. 1.

Referring to FIGS. 13-15, an exemplary end cap 15 in accordance with the present invention is illustrated with the contacts 35 therein. The end cap 15 15 preferably is formed of a plastic injection molded part of electrically nonconductive material. A plurality of chambers 130 are formed in the end cap for containing the contacting portion 131 of each contact 35. The contacting portion may be a single wipe contact surface, a dual wipe contact, a box contact, a fork contact, etc., all of which are known. In the illustrated embodiment the contacting portion 131 includes a single wipe contact arm 132 that is intended to wipe against a pin contact 133 that is inserted into the chamber 130 via the opening 17 in the front wall 16 of the end cap 15. The contact arm 132 is supported by a pair of side support legs 134 and a forward support leg 135 of the contact 35, as is seen in FIG. 13. Barbs 136 or other means may be employed to bite into walls bounding narrow recesses 137 that open at sides of chambers 130 to secure the contacts in or relative to respective chambers. Walls 138, 139 may be used to divide or separate the chambers 130 from each other.

At the back 140 of the end cap 15 the chambers 130 are open to allow contact tails 141 to extend outside the end cap for connection to the contact terminal pads 75 of the printed circuit board 72. Although the details are not illustrated in FIGS. 13–15, locking recesses 26 are formed in the edges of the end cap to receive locking tabs 25 of the cover 20. Alternatively, strain relief material may be directly molded to the back 140 of the cover in the manner illustrated in several additional embodiments of the invention, for example, those illustrated in FIGS. 24 and 26–29. To help interconnect the molded strain relief with the end cap 15 and/or to provide additional area where the cover 20 may be secured to the end cap 15, recesses and associated walls defining them may be provided in the outside surface of the end cap, as is illustrated, for example, at 142 in FIG. 14.

As viewed in FIG. 15, the chambers 130 include both a central portion 143 in which the contacting portion 131 of the contact 35 is located, and it also includes a mounting portion or recesses 137 in which the side support arms 134 and through which the front support arm 135 of the contact fit to hold the contact securely in the chamber. The opening 17 in the front wall 16 of the end cap 15 leads into the chamber portion 130 to receive a pin contact 133, for example, therein for connection with the respective contact 35, as is illustrated at the lefthand portion of FIG. 14. It will be appreciated that the end cap described is designed to be part of a female type connector to receive pin contacts inserted therein. However, other types of end caps and mounting structures for the contacts 35 may be employed, as is well known in the art.

Figure 17:
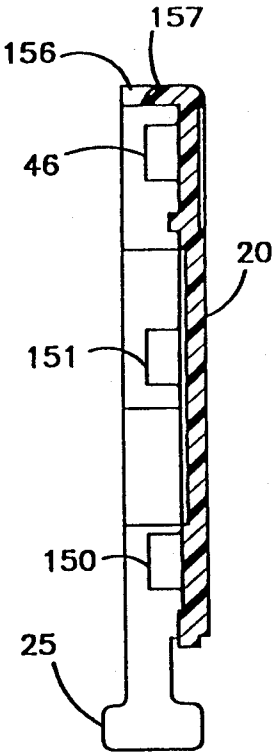
FIG. 17 is an edge view in section of the cover looking generally in the direction of the arrows 17—17 of FIG. 16.
Figure 18:
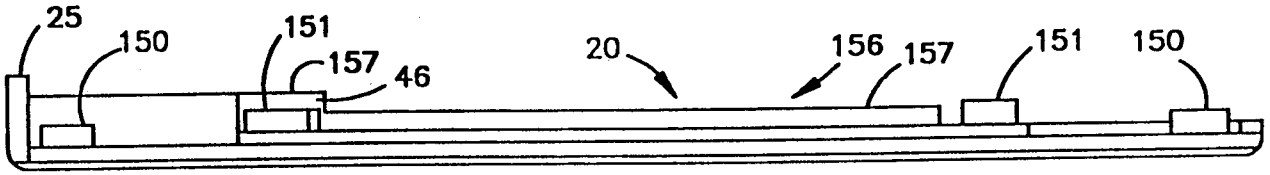
FIG. 18 is a front view of the cover looking in the direction of arrows 18—18 of FIG. 16.
Figure 19:
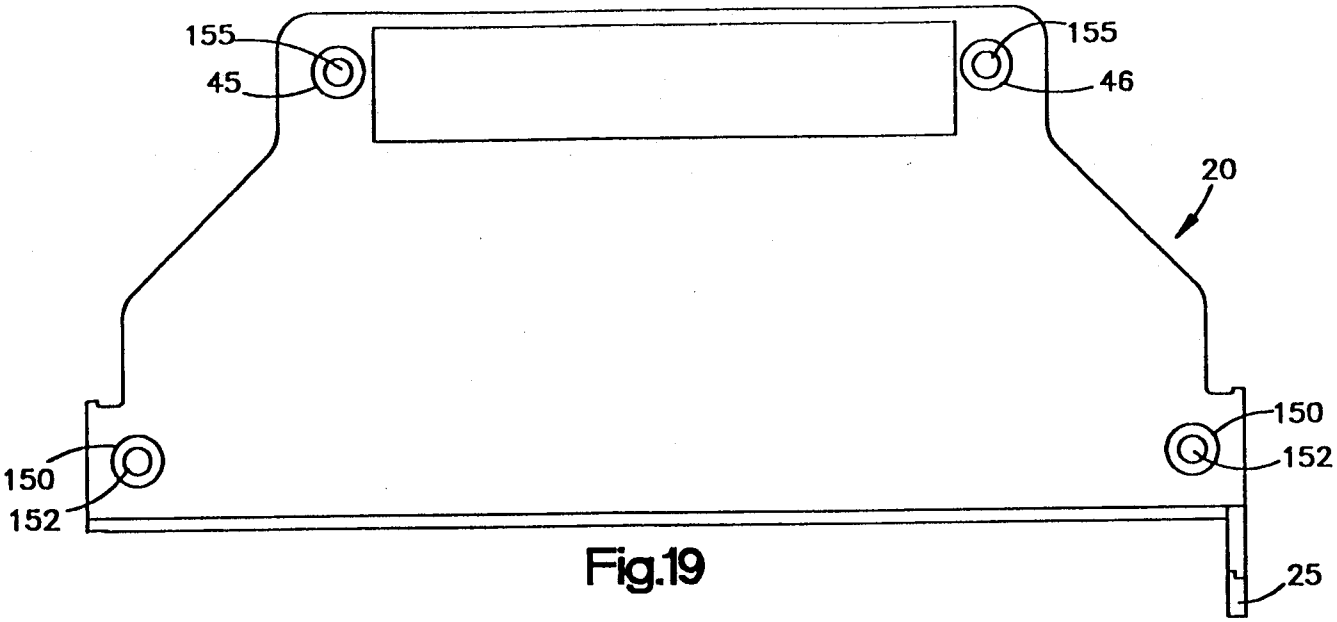
FIG. 19 is a plan view of the outside of the cover of FIG. 16.

The cover 20 is shown in detail in FIGS. 17–19. Preferably the cover 20 is a molded plastic part made by plastic injection molding technique. Various conventional electrically nonconductive materials may be used to form the cover. The cover is made in two parts 21*a*, 21*b*, each of which preferably is identical so that they can be placed in sandwiched relation with the circuit board 72 therebetween, the strain relief bar 31 held in the recess 32, and the end cap 15 secured thereto, as by the locking tabs 25 located in locking recesses 26. Platforms 150, 151 in the cover may be used to provide support for the printed circuit board 72, and openings 152 through one or more of such platforms may be used to locate and to pass through rivets 23 or other fasteners, which preferably also pass through the circuit board, to secure the cover parts 21*a*, 21*b* to each other and also to secure the circuit board in fixed position therein.

The ends of the recess 32 also are bounded by platforms 45, 46 to prevent sliding movement of strain relief bar 31. Openings 155 through the platforms 45, 46 allow rivets or like fasteners 23 to pass therethrough to secure the back end of the cover parts 21*a*, 21*b* together. A relief 156 formed in the back wall 157 of the cover 20 and in each cover part 21*a*, 21*b* provides a space for the cable 12 to pass into and/or out of the cover when the two cover parts are attached together. The relief 156 may include some curvature, taper, etc. to avoid damaging the cable when the cable is bent relative to the cover.

An advantage to using the arrangement of the cover 20, printed circuit board 72, and end cap 15, as has been described above, is that the cover and the end cap 15 may be standardized. By changing the cable or the number of conductors in the cable, by changing the arrangement and/or number of circuit paths on the circuit board, etc., various pin-out or conductor-out arrangements between cable conductors 13 and contacts 35 can be made, as may be desired. Also, the cable termination 11 then may be used with cables of a variety of sizes, i.e. having various numbers of conductors therein from a maximum, which is a function of the number of contacts 35, and the number of conductors that can be placed in a cable having a width that will fit within the relief 156, for example to a smaller size cable and smaller number of contacts and conductors.

An assembled cable termination assembly 10 according to the invention, which employs the various features described above in FIGS. 1–19, is illustrated in FIG. 20. The cable 12 includes a plurality of conductor loops 71 that are coupled to conductive paths on the circuit board 72 which in turn are connected to contacts 35 that are mounted in the end cap 15. The cover parts 21*a*, 21*b* hold the circuit board and end cap in relative positions, and the covers cooperate at the recess 32 thereof to retain the strain relief bar 31 and, thus, the cable 12 in position relative to the cover and other parts of the cable termination 11.

To make the cable termination assembly 10 of FIG. 20, the cable is prepared by forming the strain relief bars 31 thereon and by forming the conductor loops 71 thereof. The conductor loops 71 are attached to the various terminal pads and printed circuit traces on the circuit board 72. Preferably the terminal pads 73 or the exposed conductors 13*a* are precoated with solder that is reflowed in a vapor phase or other solder reflow process. The end cap 15 is assembled with the contacts 35 therein and the contact tails 141 are placed into engagement with respective contact terminal pads 75 on the printed circuit board 72 and preferably are attached by soldering, welding or the like. Preferably the contact tails 141 on the contact terminal pads 75 are precoated with solder which is reflowed, e.g., as above. The cover parts 21*a*, 21*b* then are placed relative to each other to sandwich therebetween a portion of the cable 12, the strain relief bar 31, the circuit board 72, and part of the end cap 15, and the locking tabs 25 are pressed into the locking recesses 26 in the end cap where they are held in place by frictional engagement, etc. Fasteners, such as rivets 23, may be installed in the openings 152, 155 to secure the cover halves together, thus completing the cable termination assembly 10.

Cable Termination Assembly With Supplemental Tower 200

Figure 22:
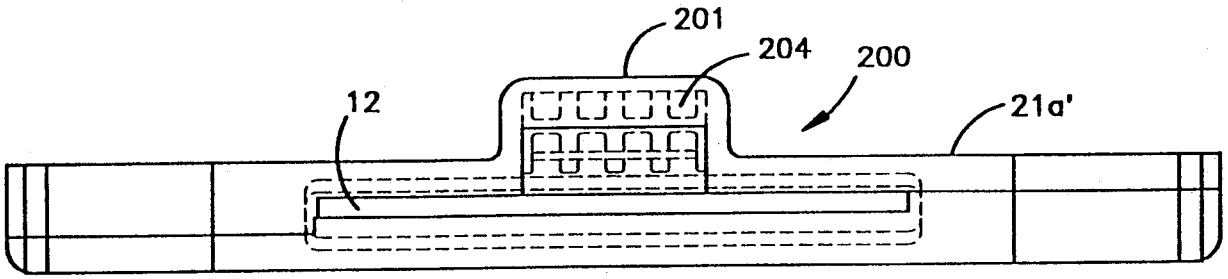
FIG. 22 is a back elevation view of the cable termination of FIG. 21 looking generally in the direction of the arrows 22—22 thereof.
Figure 21:
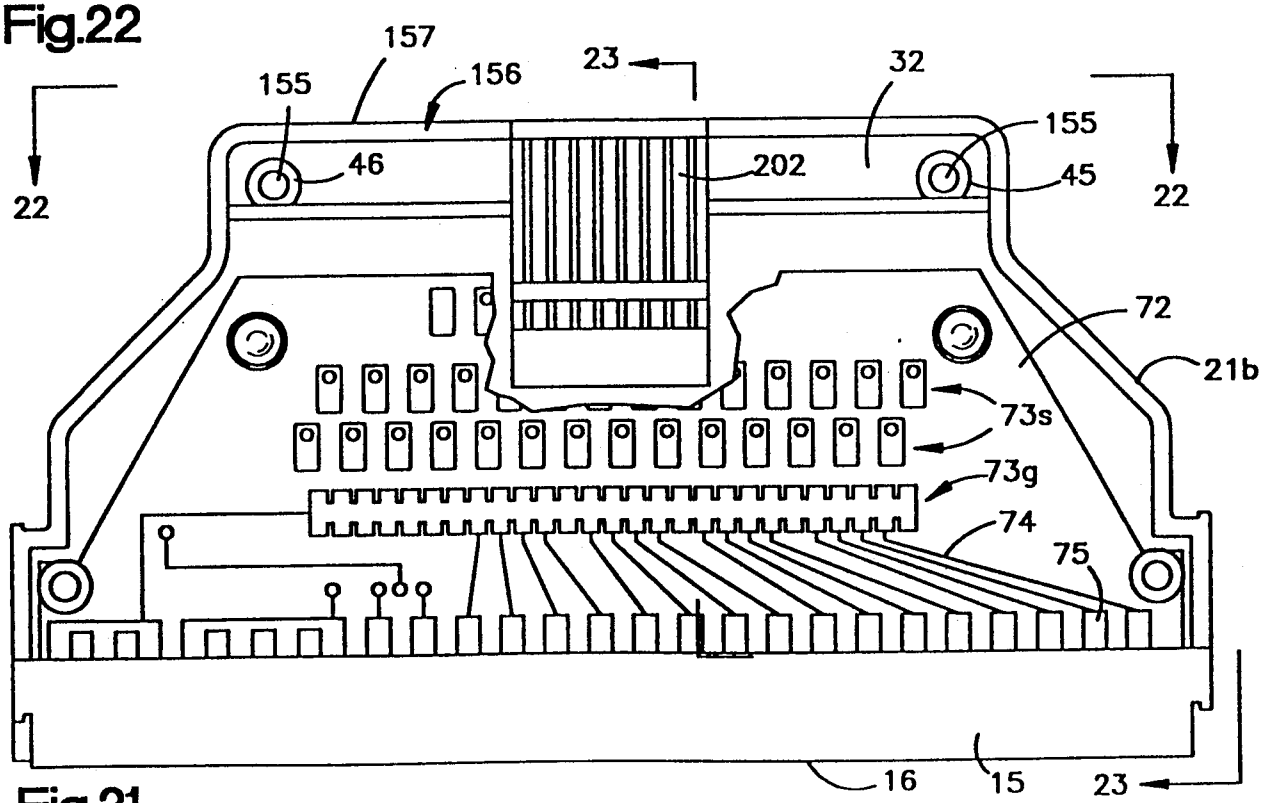
FIG. 21 is a bottom plan view, partly broken away, of a modified cover and circuit board of one alternate embodiment of cable termination using a tower in accordance with the present invention.

In FIGS. 21–23 is shown an alternate embodiment of cable termination assembly according to the invention, which is generally designated at 200. The cable termination assembly 200 is similar to the cable termination assembly 10 described above. However, there is a modification in the form of the upper cover part 21*a*' in that it includes a tower 201 in which are located a number of contacts 202, which may be connected by contact arms 203 to respective conductive traces on the printed circuit board 72. The contacts 202 may be, for example, box contacts that receive a pin contact into the hollow thereof or they may be other type of contact. An opening 204 at the back of the cover part 21a' provides access to the contact 202 so that a probe, pin contact or the like can be inserted into connection therewith. Alternatively, the contact 202 may be replaced with another element, or electrical component, such as a resistor, integrated circuit, etc., that is arranged to fit within the tower 201.

According to the embodiment illustrated in FIGS. 21-23, then, it will be appreciated that the tower 201 and additional contacts 202 provide a means for coupling another connector, other signals, etc. both to the cable 12 (and the conductors 13 thereof) and to the external member to which the cable termination assembly 200 is intended to be connected (e.g., pin contacts 133) via connections made at the end cap 15. Various other portions of the cable termination assembly 200 that are not described specifically here are similar in form and function to those described above with respect to the cable termination assembly 10, and this also is the case for other embodiments described below.

Cable Termination Assembly 62 With Directly Molded Housing

Referring to FIG. 24, another embodiment of cable termination assembly 62 in accordance with the present invention is illustrated. The cable termination assembly 62 is similar to the cable termination assembly 10 described above except that instead of a cover 20 made from separate parts, a body 63 of plastic or like material is directly molded in the end cap 15, circuit board 72, cable 12 and strain relief bar 31 to form an integral structure therewith. The cable termination assembly 62 may be made by first preparing the cable 12 in the manner described above and securing the various loops 71 to the circuit board 72. A plug member 211 is installed over the contact tails 141 at the back 140 of the end cap 15 to block plastic from flowing into the chambers 130 when the body 63 is molded. The circuit board then is attached by physical placement and preferably by soldering, welding or the like to the tails 141 of the contacts 35, which are mounted in the end cap 15. The printed circuit board 72 also blocks flow of plastic into the chambers 130 during molding. Thereafter, such assembled components may be placed in a mold of a plastic injection molding machine, and the body 63 may be molded to form the structure illustrated in FIG. 24. Preferably the body 63 substantially completely encloses the strain relief bar 31 and the circuit board 72 as well as the contact tails 141 to hold them securely and to provide the above described strain relief function. Also, during molding a locking portion 212 of material fills the recess 142 in the end cap 15 to lock the body 63 to the end cap. If the materials are suitable and if molding conditions are conducive, the material of the body 63 may bond to the cable insulation 14 and/or to the end cap 15. The molded material of the body 63 also may enter slots, weave, etc. in the cable 12 further to secure the cable in the cable termination assembly 62 and contributing to the strain relief function.

Cable Termination Assembly 300

Figure 25:
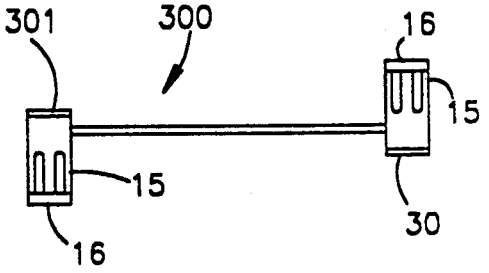
FIG. 25 is an edge elevation view of a cable termination assembly in accordance with the invention using cable terminations that project in a direction generally perpendicularly with respect to the major axial extent of the cable.

Another embodiment of cable termination assembly illustrated in FIGS. 25-29 is designated 300. Various features of the cable termination assemblies described above, especially insofar as preparation of the cable 12 is concerned, are employed in the cable termination assembly 300. The cable termination 301 extends generally perpendicularly with respect to the major axial extent of the cable 12. As is illustrated in FIG. 25, the cable terminations 301 at opposite ends of the cable 12 can face in opposite directions. Alternatively, they may face in the same direction. Still further, in addition to the cable termination 301 at one end of the cable 12, a different type of cable termination may be used at the other end of the cable. Furthermore, the cable termination 301 may be connected to the cable 12 intermediate the ends of the cable to form a daisy chain configuration.

Figure 26:
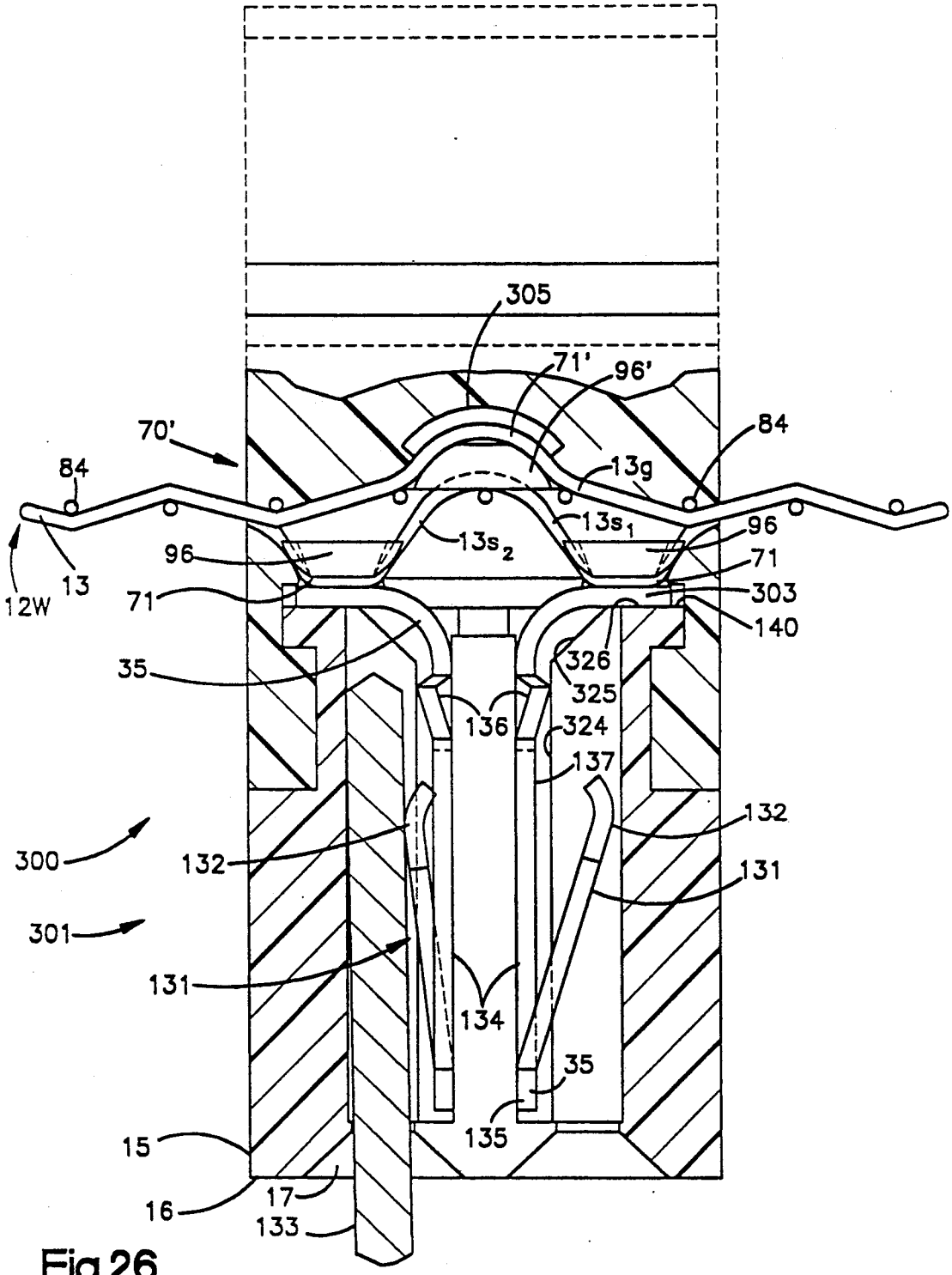
FIG. 26 is an edge elevation view, partly in section, of a cable termination assembly for woven cable useful in the cable termination assembly arrangement of FIG. 25, for example, in a daisy chain configuration, etc.
Figure 27:
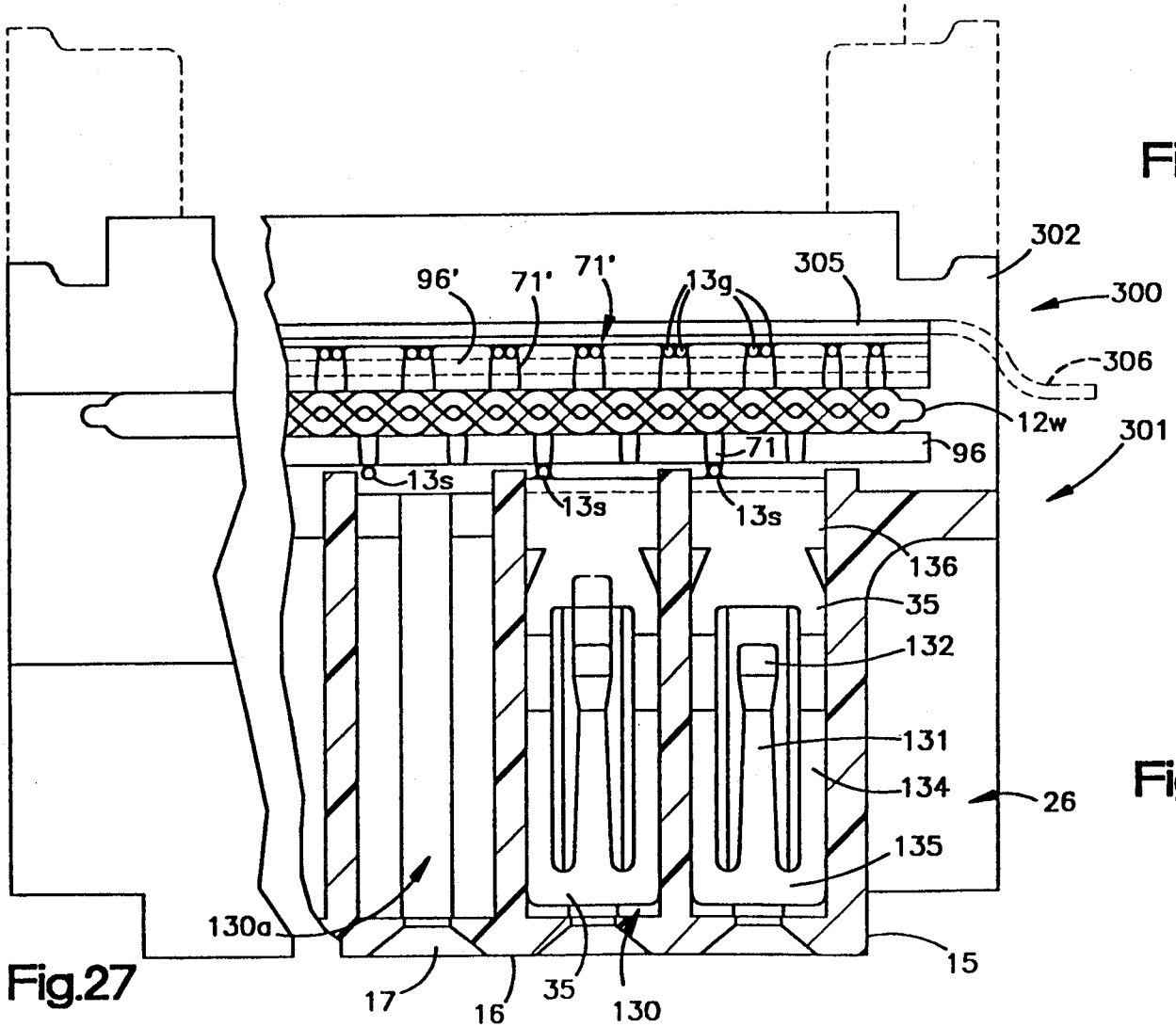
FIG. 27 is a side elevation view, partly in section, of the cable termination assembly of FIG. 26.
Figure 28:
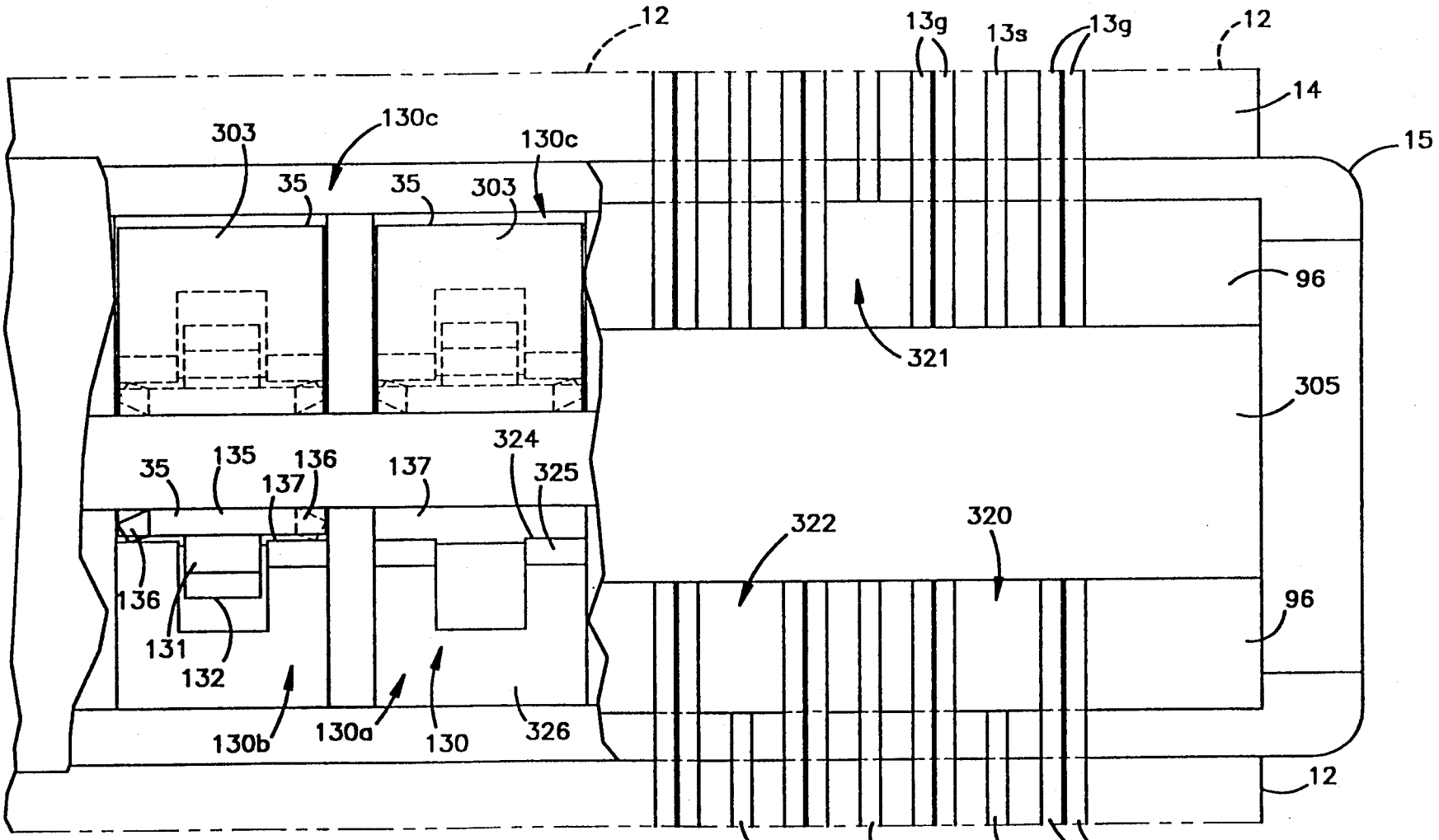
FIG. 28 is a back view, broken away in several planes, of the cable termination assembly of FIG. 26.

Turning to FIGS. 26-28, the cable termination assembly 301 includes a woven cable 12W, an end cap 15 containing contacts 35, and a strain relief body 302 which cooperates with the end cap to form the termination housing and is molded directly to part of the cable, contacts, and end cap. The contacting portions 131 of the contacts 35 are similar to those described above. However, the tails 303 of the contacts are bent over at the back 140 to cover the back end of the respective chamber 130 in which the contact is located in the end cap 15. Preferably the contact 35 and especially the bent tail 303 thereof are relatively close fitting with respect to the walls of the end cap 15 that bound the chamber 130 in order to tend to block the flow of the material of which the strain relief 302 is molded during the molding process. Therefore, the chambers 130 are maintained relatively clear of the strain relief molding material so that an external member 133, such as a pin contact, can be freely inserted into the chamber to engage the contacting portion 131 of the contact 35 to make an electrical connection therewith.

The woven cable 12W is prepared generally in the manner described above to include a plurality of conductor loops 71 that are aligned with the tails 303 of respective contacts 35 to engage the contacts for electrical connection therewith. Inserts, picks or spacers 96 are inserted into the weave of the cable during the weaving process to form the loops 71 in the manner described above providing exposure and stiffening of the conductor loops. The conductor loops 71 preferably are attached to the contact tails 303 by soldering, welding, or the like. In the preferred embodiment the contact tails 303 are pre-coated with a solder material that can be reflowed using induction, laser, vapor, or other heat applying technique.

A modified arrangement for exposing and interconnecting the ground conductors 13g is illustrated in the cable termination assembly 300. An additional insert 96' (like insert 96) is inserted into the cable 12W during the weaving process to force the ground conductors into loops 71' in a direction opposite to the direction that the signal loops 71 extend. The ground loops 71' preferably include exposed ground wire conductors 13g that protrude out of the plane of the cable. All or fewer than all of the ground conductors may be so formed to include such loops 71', as may be desired according to the particular requirements of the cable 12W and cable termination assembly 300. One or more of the ground conductors 13g may include a loop 71 that engages a contact 35, such loop being in addition to or alternative to the loop 71' just described. Similarly, a signal conductor 13s may include a loop 71' facing away from the contacts 35 in addition to or alternatively to a loop 71 for connection to a contact 35.

All of the ground conductors 13g that have a loop 71' preferably are electrically connected together by a member, such as, for example, an electrically conductive bus strip 305. Other means also may be used to connect the ground conductors 13g together, as by soldering or using some other technique. If desired, an end 306 of the bus strip 305 can extend outside the molded strain relief body 302 and/or other portion of the cable termination 301 for connection to another member, e.g. to a grounding strap or the like.

As is seen in FIG. 27, the woven cable 12W is positioned relative to contacts 35 that are mounted in the end cap 15. A respective signal conductor 13s is connected to each respective contact 35, and each contact 35 has a contacting portion 131 in a respective chamber 130. Chamber 130a is vacant to show features of the chamber, although it is expected that a contact would be located in that chamber. Also, each ground conductor 13g preferably is soldered or otherwise securely connected to the ground bus 305.

The strain relief material or body 302 is directly molded to the cable, contacts and end cap, as is seen in FIG. 26. Preferably the strain relief material secures itself to the end cap by flowing into recesses 142 in the end cap 15 so that tab-like portions 311 of the strain relief 302 bind or lock in those recesses. Also, if desired, the strain relief material 302 may bond chemically with the material of which the end cap 15 is formed. Preferably the strain relief material 302 penetrates or permeates through the weave of the cable 12W to secure the cable in the cable termination 301 even without a strain relief bar 31.

Briefly referring to FIG. 28, a back view of the cable termination assembly 300 schematically is shown, the illustration being broken at several sections or planes to show representative ground conductors 13g and signal conductors 13s relative to positioning of inserts 96. At spaces 320, 321 and 322 the respective signal conductors $13s_1$, $13s_2$, $13s_3$ are not seen; only the insert 96 is seen, for the respective signal conductors 13s form respective loops 71 for engagement with respective contacts 35. The bus 305 hides the area therebeneath where the loops 71' of the ground conductors 13g connect therewith. To the lefthand portion of FIG. 28 the chambers 130 are seen in several views. In chamber 130a the contact has been omitted to facilitate the illustration. A slot-like zone 137 is where the contact legs 134 extend and barbs 136 bite into the plastic or other material of the end cap 15. This is seen in chamber 130b. The contacting portion 131 and the contacting surface 132 extend into the area of the chamber 130 that is directly aligned with the opening 17 in the end cap 15 to be able to engage a pin contact or other member inserted into engagement therewith. Near the back of the wall 324 which in part forms the slotlike recess 137 is a sloped area 325 about which the tail 303 of the contact 35 is bent over, and such bent-over tail may rest against the back surface 326 of the chamber 130. The bent-over tails 137 of respective contacts 35 are seen in the chambers 130c at the upper left portion of the illustration of FIG. 28.

Figure 29:
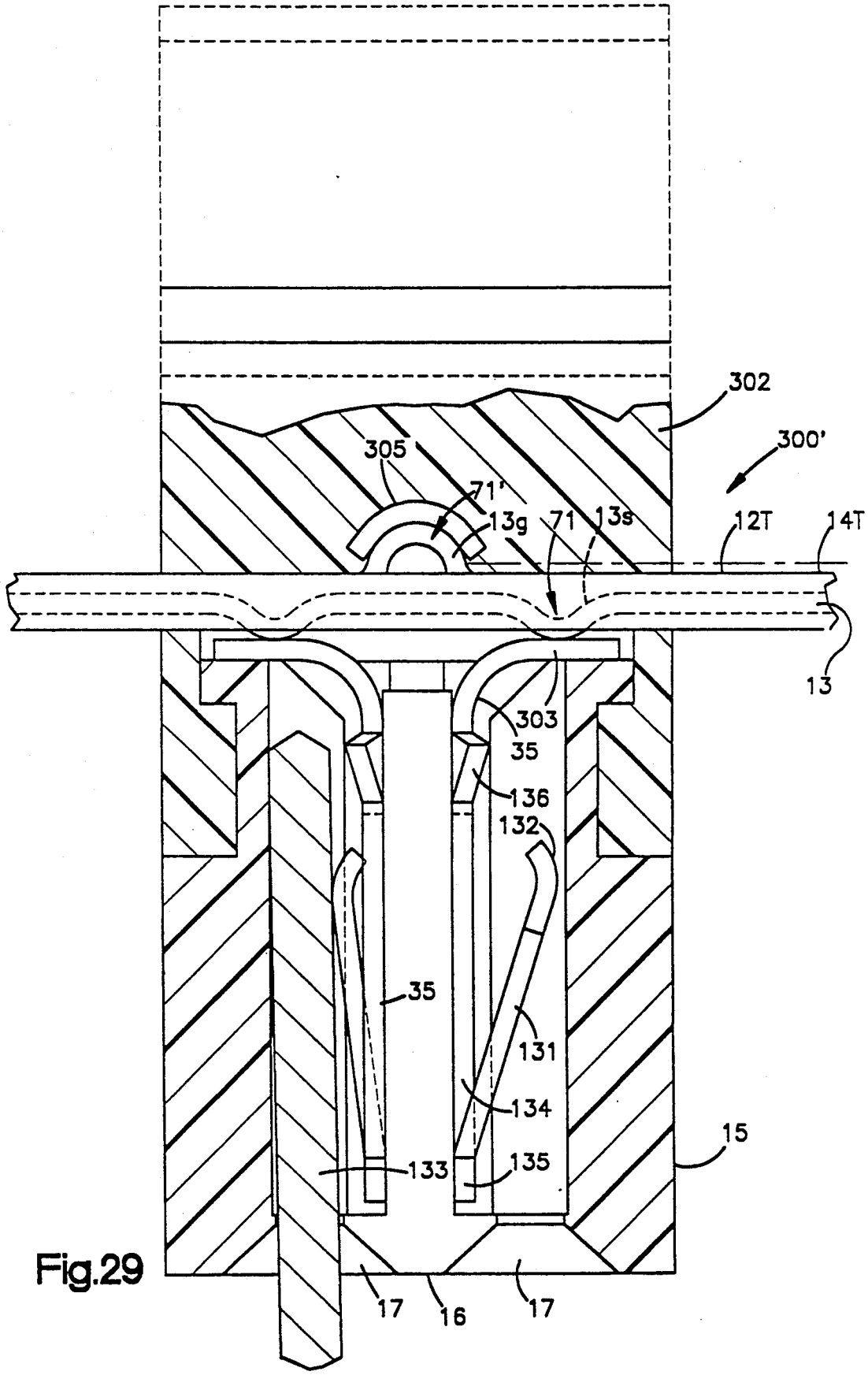
FIG. 29 is an edge elevation view of a cable termination assembly with Teflon cable useful in the cable termination assembly configuration of FIG. 25.

Briefly turning to FIG. 29, a cable termination assembly 300' is illustrated. The cable termination assembly 300' is substantially identical to the cable termination assembly 300 except that the cable used is a Teflon cable 12T. Loops 71 and 71' are formed in the respective conductors 13 of the Teflon cable 12T. Such loops are formed in the manner described above for the Teflon cable 12T illustrated in FIGS. 7-9, for example. Moreover, the loops 71' are formed in a manner similar to the loops 71 except that the loops 71' are formed in the ground conductors 13g and extend in a direction opposite to the direction that the loops 71 extend. A ground bus 305 interconnects all the ground conductors 13g. The contacts 35 and end cap 15 for the cable termination assembly 300' are the same as those described above with respect to FIGS. 25-28. The strain relief body 302 preferably is directly molded to the cable 12T and to the end cap 15, and such strain relief body preferably penetrates through openings in the cable where the respective loops are formed in order to secure the cable in the strain relief body and, thus, in the cable termination assembly.

Pull Tab Arrangement 350

Figure 31:
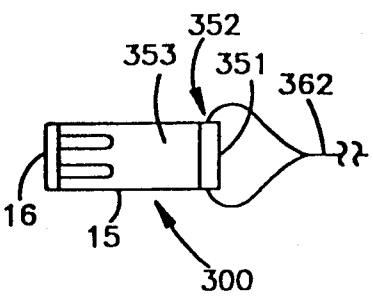
FIG. 31 is an edge elevation view of the cable termination of FIG. 30 looking generally in the direction of the arrows 31—31 thereof.
Figure 30:
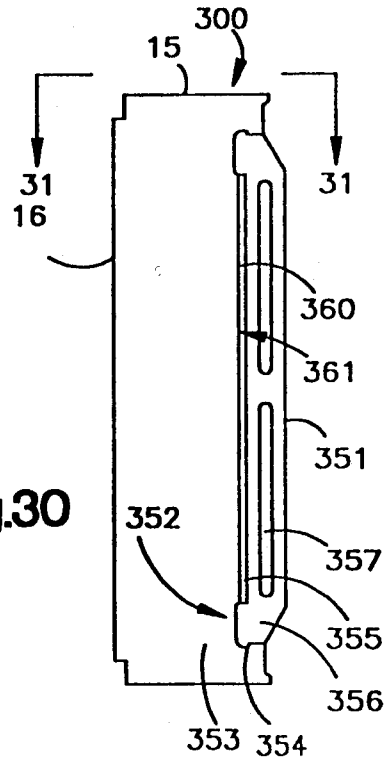
FIG. 30 is a schematic illustration of a cable termination assembly in accordance with the present invention using a holder to mount a pull tab to the cable termination.

Referring to FIGS. 30 and 31, a pull tab arrangement 350 is shown for use in connection with a cable termination assembly, such as those described above, especially those with a directly molded strain relief, namely 210 and 300. The pull tab arrangement 350 is shown used with a cable termination assembly 300 as one example, but it may be used with other types of cable termination assemblies, as will be appreciated. The objective of the pull tab arrangement 350 is to facilitate mounting a pull tab to a cable termination to pull the cable termination away from another cable termination, terminal board, etc., to which it is connected. Often the profile or height of the cable termination is relatively small, which makes it difficult to grasp manually (or even with a tool) to apply adequate and preferably uniform force to effect such withdrawing function. Moreover, it often is desirable that the height or profile of a cable termination be relatively small in order to minimize the space required for it. The pull tab arrangement 350 allows a cable termination 300 to be made with a relatively small profile for some uses. However, where it is acceptable for the cable termination 300 to have a relatively high profile, the pull tab arrangement can be installed in a separate procedure. Therefore, the cable termination 300 shown in FIGS. 30 and 31 would have the versatility of both low profile and, if space permits, high profile that allows easier withdrawing.

The pull tab arrangement 350 includes two primary parts, namely a bar 351 and a connection 352 between the bar 351 and the body 353 of the cable termination 300. Preferably the connection 352 is an undercut (or molded) slot 354 in a recess 355 at the back of the body 353 and a tab 356 in the bar 351. The bar 351 may be deformed resiliently to allow the tabs 356 to be inserted into the recesses 354; alternatively, the bar, more particularly the tabs 356, may be slid into the recesses 354 from the open side thereof. The bar preferably is formed of plastic or other material that facilitates molding the same using plastic injection molding technique. Alternatively, the bar 351 may be of metal or some other material. The bar 351 may have slot-like recesses 357 therein to facilitate secure grasping of it manually or by a tool, or those slot-like recesses may help provide rigidity or stiffness. Between the bar 351 and the surface 360 of the recess 355 is a space 361 in which strips of ribbon-like pull tabs 362, for example of plastic or other material, may be inserted. The pull tab strips may be secured about the bar 351. The pull tab strips 362 may be grasped manually and pulled to withdraw the cable termination 300 from connection with an external member.

STATEMENT OF INDUSTRIAL APPLICATION

In view of the foregoing it will be appreciated that the present invention provides means for terminating the conductors of a multiconductor cable for use in electrical signal transmission and especially for use in high speed signal transmission.

We claim:

1. A cable termination assembly comprising:

a) a planar ribbon cable having plural electrical conductors arranged in a generally parallel, elongate, spaced apart relation;

b) a plurality of said electrical conductors having connection portions located along the length of the cable, in spaced-apart relation, at least some of said connection portions protruding to one side of said cable;

c) insert means for insertion between the major planar extent of said ribbon cable and at least some of said connection portions on said one side of said cable, to rigidify said at least some of said connection portions and hold apices of said at least some of said connection portions in substantially coplanar relation;

d) electrical conducting means for conducting electrical signals with respect to such connection portions;

e) electrically non-conductive means for holding said cable and electrical conducting means in positional relationship for such electrical conducting function;

f) wherein said cable comprises woven cable, said conductors include plural signal conductors and plural ground conductors and said conductors undulate in a weave pattern forming respective loop-like portions extending away from the central generally planar axis of said cable;

g) said insert means comprising a plurality of relatively rigid rod-like inserts positioned between respective loop-like portions of conductors and such generally planar axis of said cable to rigidify such respective loop-like portions;

h) said inserts being located axially along the length of said cable; and i) wherein said loop-like portions form such respective connection portions of said cable.

2. The assembly of claim 1, said electrical conducting means comprising electrically conductive paths on a printed circuit board, said paths being connected to respective conductors of said cable.

3. The assembly of claim 2, said electrical conducting means further comprising electrical contacts connected to respective paths, whereby said printed circuit board provides an interface between respective conductors and respective contacts.

4. A cable termination assembly comprising:

a) a planar ribbon cable having plural electrical conductors arranged in a generally parallel, elongate, spaced apart relation;

b) a plurality of said electrical conductors having connection portions located along the length of the cable, in spaced-apart relation, at least some of said connection portions protruding to one side of said cable;

c) insert means for insertion between the major planar extent of said ribbon cable and at least some of said connection portions on said one side of said cable, to rigidify said at least some of said connection portions and hold apices of said at least some of said connection portions in substantially coplanar relation;

d) electrical conducting means for conducting electrical signals with respect to such connection portions; and e) electrically non-conductive means for holding said cable and electrical conducting means in positional relationship for such electrical conducting function;

f) said cable comprising multiconductor ribbon cable having substantially continuous insulation across the width of the cable, openings in said insulation at a plurality of said conductors generally coextensive with a short length of such respective conductors, and protruding loop portions of respective conductors extending outside the plane of said cable through such respective openings to form said connecting portions;

g) said openings comprising slit-like openings in said insulation generally parallel with respective conductors and having flaps of material extending toward the apices of said respective protruding loop portions for stiffening such portions.

5. A cable termination assembly comprising:

a) a cable including at least two parallel conductors embedded in an insulating ribbon, in which the insulating ribbon defines a surface parallel to a direction of the conductors and at least one of the conductors includes a conductive loop which projects through the surface of the insulating ribbon;

b) an insert held between the conductive loop and the surface of the insulating ribbon for supporting the conductive loop;

c) a contact in electrical communication with the loop for connection with an external member; and d) an electrically non-conductive cover for supporting the cable and contact.

6. A cable termination assembly according to claim 5 wherein the cable is selected from the group consisting of woven ribbon cables and ribbon cables having continuous insulation across the widths of the cables.

7. A cable termination assembly according to claim 5 including a printed circuit board which is supported by the cover and has an electrically conductive path connected at one end to the conductive loop and at another end to the contact to provide electrical communication between the conductive loop and the contact.

8. A cable termination assembly according to claim 5 wherein the cable is a ribbon cable having continuous insulation and wherein the conductive loop projects through an opening in the surface of the insulating ribbon.

9. A cable termination assembly according to claim 5 wherein the cable is a woven ribbon cable and the assembly includes a strain relief molded over a portion of the cable such that a portion of the strain relief penetrates the weave of the cable.

10. A cable termination assembly according to claim 5 wherein the cable is a ribbon cable having continuous insulation having openings in the insulating ribbon and the assembly includes a strain relief molded over a portion of the cable such that a portion of the strain relief extends into the openings in the insulating ribbon.

11. A cable termination assembly comprising:

a) an insulating ribbon defining a surface;

b) parallel signal-carrying conductors embedded in the ribbon, each signal-carrying conductor including a loop projecting through the surface of the ribbon along one or more rows transverse to a direction of the signal-carrying conductors;

c) ground conductors embedded in the ribbon between adjacent signal-carrying conductors, each ground conductor including a loop projecting through the surface of the ribbon along one or more rows transverse to the direction of the signal-carrying conductors;

d) at least one insert held between one of the rows of conductive loops and the surface of the insulating ribbon for supporting that row of conductive loops;

e) a printed circuit board having one or more rows of interconnected terminals pads for connection with the conductive loops of the ground conductors and one or more conductive paths including terminal pads for connection with the conductive loops of the signal-carrying conductors;

f) contacts connected with the conductive paths on the printed circuit board for electrically coupling the signal-carrying conductors with an external member; and g) a cover for supporting the cable, the printed circuit board and the contacts.

* * * * *